US009216874B2

(12) United States Patent
Wakai

(10) Patent No.: US 9,216,874 B2
(45) Date of Patent: Dec. 22, 2015

(54) CONTROL APPARATUS, CONTROL METHOD, AND STORAGE MEDIUM

(71) Applicant: CANON KABUSHIKI KAISHA, Tokyo (JP)

(72) Inventor: Kazuo Wakai, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/287,508

(22) Filed: May 27, 2014

(65) Prior Publication Data

US 2014/0353909 A1 Dec. 4, 2014

(30) Foreign Application Priority Data

Jun. 3, 2013 (JP) ..... 2013-117373

(51) Int. Cl.

| | |
|---|---|
| ***B65H 31/36*** | (2006.01) |
| ***B65H 33/08*** | (2006.01) |
| ***G03G 15/00*** | (2006.01) |
| ***B65H 43/00*** | (2006.01) |

(52) U.S. Cl.

CPC ..... *B65H 33/08* (2013.01); *B65H 43/00* (2013.01); *G03G 15/6547* (2013.01); *B65H 2301/4212* (2013.01); *B65H 2301/4219* (2013.01); *B65H 2511/20* (2013.01); *G03G 2215/0089* (2013.01)

(58) Field of Classification Search

CPC .... B65H 29/00; B65H 31/00; B65H 2408/11; B65H 2301/4212; B65H 2301/4217; B65H 2301/4219; B65H 2301/42192; B65H 2301/42194; B65H 2301/422; B65H 33/06; B65H 33/08; G03G 15/6547; G03G 2215/0089

USPC ..... 414/791.2

See application file for complete search history.

(56) References Cited

U.S. PATENT DOCUMENTS

| | | | | |
|---|---|---|---|---|
| 4,865,308 | A * | 9/1989 | Krasik | 271/213 |
| 8,020,844 | B2 * | 9/2011 | Takenouchi et al. | 270/1.01 |
| 8,100,393 | B2 * | 1/2012 | Ray et al. | 270/58.31 |

(Continued)

FOREIGN PATENT DOCUMENTS

| | | | |
|---|---|---|---|
| JP | 2006-256792 | A | 9/2006 |
| JP | 2007-62866 | A | 3/2007 |

(Continued)

OTHER PUBLICATIONS

European Search Report dated Oct. 31, 2014 issued in corresponding European Patent Application No. 14170479.1.

*Primary Examiner* — Prasad Gokhale

(74) *Attorney, Agent, or Firm* — Fitzpatrick, Cella, Harper & Scinto

(57) ABSTRACT

A control apparatus discharges, into a stacking unit, sheets of a plurality of copies obtained by executing a first job that is set to print a plurality of copies, and discharges sheets of a plurality of copies obtained by executing a second job that is set to print a plurality of copies and follows the first job. The control apparatus carries out control so that a sheet discharge position for copies discharged by executing the first job changes from a first discharge position in the stacking unit to a second discharge position in the stacking unit between copies, and carries out control so that a sheet discharge position for the plurality of copies discharged by executing the second job changes from a third discharge position in the stacking unit to a fourth discharge position in the stacking unit between copies.

7 Claims, 25 Drawing Sheets

(56) References Cited

U.S. PATENT DOCUMENTS

| | | | | |
|---|---|---|---|---|
| 2008/0154426 | A1 | 6/2008 | Kikuchi | |
| 2010/0090387 | A1* | 4/2010 | Takenouchi et al. | 270/58.01 |
| 2013/0038013 | A1 | 2/2013 | Arai et al. | |
| 2013/0249166 | A1* | 9/2013 | Abe et al. | 271/314 |

FOREIGN PATENT DOCUMENTS

| | | | |
|---|---|---|---|
| JP | 2008-150204 | A | 7/2008 |
| JP | 2009-7151 | A | 1/2009 |
| JP | 2013-86892 | A | 5/2013 |

* cited by examiner

FIG. 5A

SHIFT SETTING INFORMATION HOLDING TABLE

| | |
|---|---|
| CURRENT SHIFT POSITION NUMBER | 0 |
| PREVIOUSLY-USED JOB-TO-JOB SHIFT POSITION NUMBER | 1 |
| PREVIOUSLY-USED COPY-TO-COPY SHIFT POSITION NUMBER | 3 |

FIG. 5B

SHIFT POSITION MANAGEMENT TABLE

| SHIFT POSITION NUMBER | OFFSET AMOUNT |
|---|---|
| 0 | 0 |
| 1 | 2X |
| 2 | -2X |
| 3 | X |
| 4 | -X |

FIG. 5C

SHIFT GROUP MANAGEMENT TABLE

| SHIFT GROUP | CORRESPONDING SHIFT POSITION NUMBER | CORRESPONDING SHIFT DESIGNATION |
|---|---|---|
| JOB-TO-JOB | 1, 2 | JOB-TO-JOB SHIFT |
| JOB & COPY 1 | 1, 3 | JOB-TO-JOB SHIFT AND COPY-TO-COPY SHIFT |
| JOB & COPY 2 | 2, 4 | JOB-TO-JOB SHIFT AND COPY-TO-COPY SHIFT |
| COPY-TO-COPY | 3, 4 | COPY-TO-COPY SHIFT |

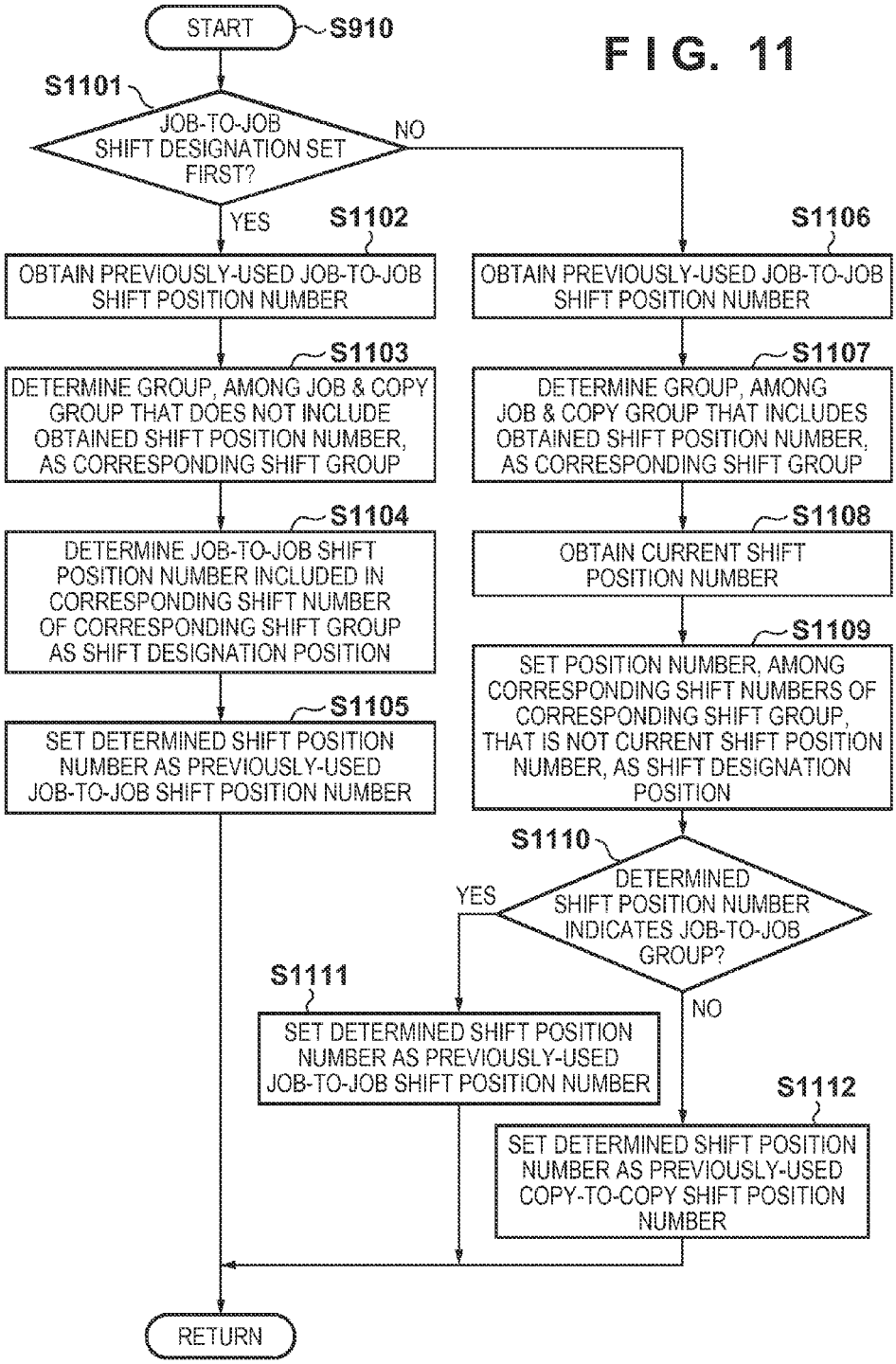
FIG. 11
START
S910
S1101
JOB-TO-JOB SHIFT DESIGNATION SET FIRST?
NO
YES
S1102
OBTAIN PREVIOUSLY-USED JOB-TO-JOB SHIFT POSITION NUMBER
S1103
DETERMINE GROUP, AMONG JOB & COPY GROUP THAT DOES NOT INCLUDE OBTAINED SHIFT POSITION NUMBER, AS CORRESPONDING SHIFT GROUP
S1104
DETERMINE JOB-TO-JOB SHIFT POSITION NUMBER INCLUDED IN CORRESPONDING SHIFT NUMBER OF CORRESPONDING SHIFT GROUP AS SHIFT DESIGNATION POSITION
S1105
SET DETERMINED SHIFT POSITION NUMBER AS PREVIOUSLY-USED JOB-TO-JOB SHIFT POSITION NUMBER
S1106
OBTAIN PREVIOUSLY-USED JOB-TO-JOB SHIFT POSITION NUMBER
S1107
DETERMINE GROUP, AMONG JOB & COPY GROUP THAT INCLUDES OBTAINED SHIFT POSITION NUMBER, AS CORRESPONDING SHIFT GROUP
S1108
OBTAIN CURRENT SHIFT POSITION NUMBER
S1109
SET POSITION NUMBER, AMONG CORRESPONDING SHIFT NUMBERS OF CORRESPONDING SHIFT GROUP, THAT IS NOT CURRENT SHIFT POSITION NUMBER, AS SHIFT DESIGNATION POSITION
S1110
DETERMINED SHIFT POSITION NUMBER INDICATES JOB-TO-JOB GROUP?
YES
NO
S1111
SET DETERMINED SHIFT POSITION NUMBER AS PREVIOUSLY-USED JOB-TO-JOB SHIFT POSITION NUMBER
S1112
SET DETERMINED SHIFT POSITION NUMBER AS PREVIOUSLY-USED COPY-TO-COPY SHIFT POSITION NUMBER
RETURN

FIG. 13A

SHIFT SETTING INFORMATION HOLDING TABLE

| | |
|---|---|
| CURRENT SHIFT POSITION NUMBER | 0 |
| PREVIOUSLY-USED JOB-TO-JOB SHIFT POSITION NUMBER | 1 |
| PREVIOUSLY-USED COPY-TO-COPY AND CHAPTER-TO-CHAPTER SHIFT POSITION NUMBER | 3 |

FIG. 13B

SHIFT GROUP MANAGEMENT TABLE

| SHIFT GROUP | CORRESPONDING SHIFT POSITION NUMBER | CORRESPONDING SHIFT DESIGNATION |
|---|---|---|
| JOB-TO-JOB | 1, 2 | JOB-TO-JOB SHIFT |
| COPY-TO-COPY & CHAPTER-TO-CHAPTER 1 | 1, 3, 0 | JOB-TO-JOB SHIFT, COPY-TO-COPY SHIFT, CHAPTER-TO-CHAPTER SHIFT |
| COPY-TO-COPY & CHAPTER-TO-CHAPTER 2 | 2, 4, 0 | JOB-TO-JOB SHIFT, COPY-TO-COPY SHIFT, CHAPTER-TO-CHAPTER SHIFT |

FIG. 19A

SHIFT SETTING INFORMATION HOLDING TABLE

| | |
|---|---|
| CURRENT SHIFT POSITION NUMBER | 0 |
| PREVIOUSLY-USED NORMAL SHIFT POSITION NUMBER | 1 |
| PREVIOUSLY-USED SPECIAL SHIFT POSITION NUMBER | 3 |

FIG. 19B

SHIFT GROUP MANAGEMENT TABLE

| SHIFT GROUP | CORRESPONDING SHIFT POSITION NUMBER | CORRESPONDING SHIFT DESIGNATION |
|---|---|---|
| NORMAL SHIFT | 1, 2 | JOB-TO-JOB SHIFT<br>COPY-TO-COPY SHIFT |
| SPECIAL SHIFT | 3, 4 | |

SPECIAL SHIFT CORRESPONDING STATE REGISTRATION TABLE

| STATE | EXECUTE SPECIAL SHIFT |
|---|---|
| PAPER JAM | ON |
| AUTOMATIC TONE CORRECTION | OFF |
| SHEET FEED TRAY CHANGE | OFF |
| OTHER ERROR | ON |

CONTROL APPARATUS, CONTROL METHOD, AND STORAGE MEDIUM

BACKGROUND OF THE INVENTION

1. Field of the Invention

The present invention relates to control apparatuses and control methods, and storage media that control the discharge position of a sheet.

2. Description of the Related Art

Among image forming apparatuses that include discharge devices having discharge functions, a "shift function" that places output paper (printed material) at the same discharge destination while changing the discharge position of the output paper is known. Using this shift function to shift the discharge position of printed material from print job to print job and stack the shifted printed material makes it possible to distinguish the printed material that corresponds to a given print job with ease (this will be referred to as "job-to-job shifting" hereinafter). Likewise, when executing a print job in which a certain number of printed copies is specified, shifting the printed material from copy to copy and stacking the printed material makes it possible to distinguish the printed material that corresponds to a given copy with ease (this will be referred to as "copy-to-copy shifting" hereinafter) (see Japanese Patent Laid-Open No. 2008-150204, for example).

However, according to the aforementioned past techniques, the discharge position is limited to two positions, namely a shifted position and an unshifted position, and thus printed materials discharged to the same discharge destination cannot be distinguished from each other based on the print job and based on individual copies within that print job at the same time.

Meanwhile, in the case where the state of a printing apparatus has changed during printing (a paper jam has occurred, for example), it is conceivable to use the shift function to identify where, in the discharged and stacked printed materials, it is likely that the state change began to affect the printed materials. However, in such a case, it is not possible to discern whether the shift function has been used for that purpose, or for identifying job-to-job shifting or copy-to-copy shifting. Separating printed materials using separately-prepared partition paper or the like can thus be considered, but this poses an additional problem in that paper is wasted in order to produce the partition paper.

SUMMARY OF THE INVENTION

The present invention enables the realization of a technique that enables job-to-job shift and copy-to-copy shift to be distinguished from each other.

One aspect of the present invention provides a control apparatus comprising: a discharge unit configured to discharge, into a stacking unit, sheets of a plurality of copies obtained by executing a first job that is set to print a plurality of copies, and configured to discharge, into the stacking unit, sheets of a plurality of copies obtained by executing a second job that is set to print a plurality of copies and follows the first job; and a control unit configured to carry out control so that a sheet discharge position for the plurality of copies discharged by executing the first job changes from a first discharge position to a second discharge position in the stacking unit between copies, and to carry out control so that a sheet discharge position for the plurality of copies discharged by executing the second job changes from a third discharge position to a fourth discharge position in the stacking unit between copies, wherein the first discharge position is different from the third discharge position and the fourth discharge position.

Another aspect of the present invention provides a control apparatus comprising: a discharge unit configured to discharge, into a stacking unit, sheets of a plurality of copies obtained by executing a job; and a control unit configured to carry out control so that a sheet discharge position for the plurality of copies discharged by executing the job changes from a first discharge position in the stacking unit to a second discharge position in the stacking unit between copies, and to carry out control so that a sheet discharge position for sheets discharged by executing a different job than the stated job changes to a third discharge position in the stacking unit that is different from the first discharge position and the second discharge position.

Still another aspect of the present invention provides a control apparatus comprising: a state monitoring unit configured to monitor whether or not a state change has occurred during executing a job; a determination unit configured to when the state monitoring unit determines a state change has occurred, determine whether or not a special shift is registered as "on" for the state change; a setting unit configured to when the determination unit determines a special shift is registered as "on" for the state change, set a special shift for the state change.

Yet still another aspect of the present invention provides a control method comprising the steps of: discharging, into a stacking unit, sheets of a plurality of copies obtained by executing a first job that is set to print a plurality of copies, and discharging, into the stacking unit, sheets of a plurality of copies obtained by executing a second job that is set to print a plurality of copies and follows the first job; and carrying out control so that a sheet discharge position for the plurality of copies discharged by executing the first job changes from a first discharge position in the stacking unit to a second discharge position in the stacking unit between copies, and carrying out control so that a sheet discharge position for the plurality of copies discharged by executing the second job changes from a third discharge position in the stacking unit to a fourth discharge position in the stacking unit between copies, wherein the first discharge position is different from the third discharge position and the fourth discharge position.

Still yet another aspect of the present invention provides a non-transitory computer-readable storage medium storing a computer program that causes a computer to execute a control method, the program comprising: discharge code configured to discharge, into a stacking unit, sheets of a plurality of copies obtained by executing a first job that is set to print a plurality of copies, and to discharge, into the stacking unit, sheets of a plurality of copies obtained by executing a second job that is set to print a plurality of copies and follows the first job; and control code configured to carry out control so that a sheet discharge position for the plurality of copies discharged by executing the first job changes from a first discharge position in the stacking unit to a second discharge position in the stacking unit between copies, and to carry out control so that a sheet discharge position for the plurality of copies discharged by executing the second job changes from a third discharge position in the stacking unit to a fourth discharge position in the stacking unit between copies, wherein the first discharge position is different from the third discharge position and the fourth discharge position.

Further features of the present invention will become apparent from the following description of exemplary embodiments (with reference to the attached drawings).

BRIEF DESCRIPTION OF THE DRAWINGS

FIGS. 5A to 5C are diagrams illustrating tables according to the embodiment, where FIG. 5A illustrates a shift setting information holding table, FIG. 5B illustrates the shift position management table, and FIG. 5C illustrates a shift group management table.

FIG. 11 is a flowchart illustrating job-to-job and copy-to-copy shift designating processing, carried out in S910 of FIG. 9.

FIGS. 13A and 13B are diagrams illustrating tables according to a second working example, where FIG. 13A illustrates an example of a shift setting information holding table, and FIG. 13B illustrates an example of a shift group management table.

FIGS. 19A and 19B are diagrams illustrating tables according to the second working example, where FIG. 19A illustrates an example of a shift setting information holding table, and FIG. 19B illustrates an example of a shift group management table.

FIG. 23A illustrates an example of a special shift correspondence state table and FIG. 23B illustrates an example of a screen for setting a device state in which special shifting is to be carried out (special shift setting registration).

DESCRIPTION OF THE EMBODIMENTS

Embodiments of the present invention will now be described in detail with reference to the drawings. It should be noted that the relative arrangement of the components, the numerical expressions and numerical values set forth in the embodiments do not limit the scope of the present invention unless it is specifically stated otherwise.

Figure 1:
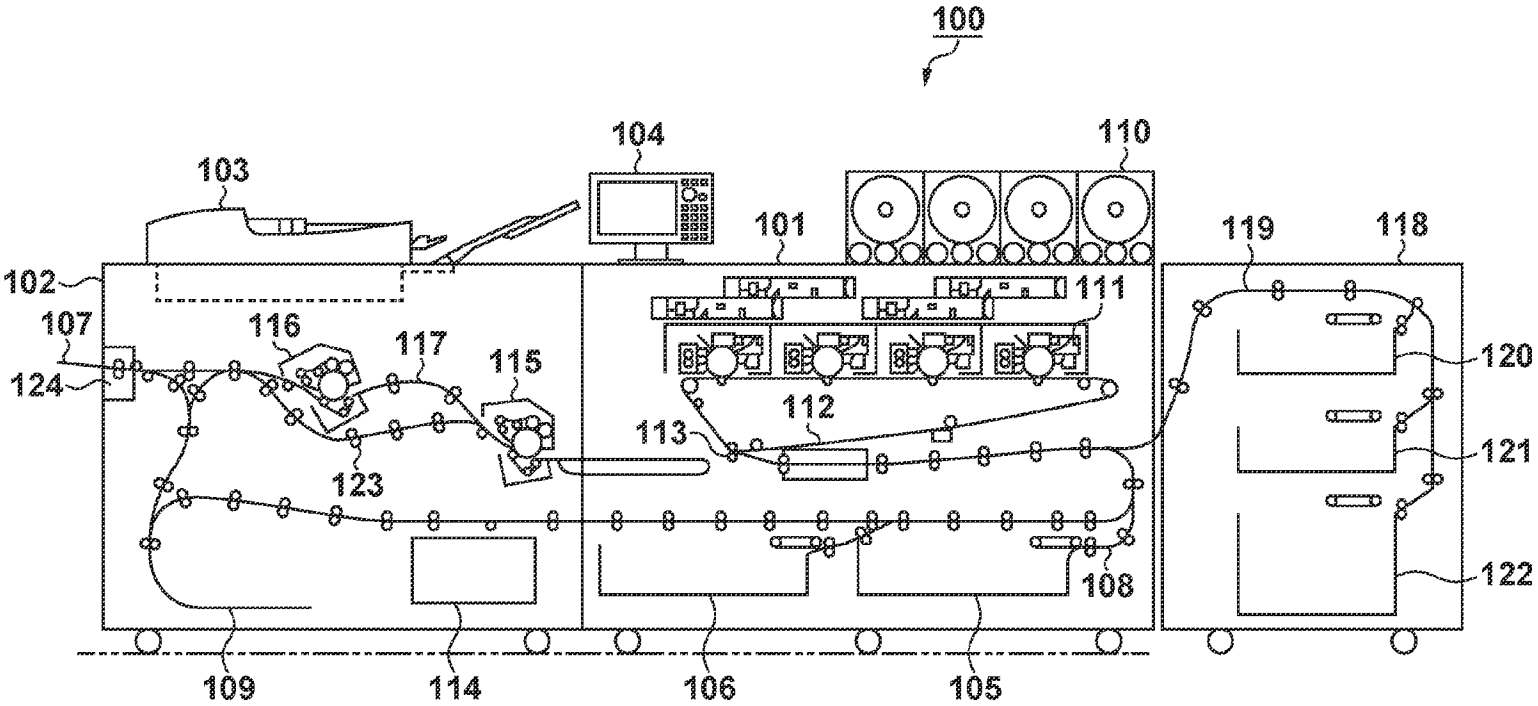
FIG. 1 is a cross-sectional view illustrating an example of the configuration of an image forming apparatus according to an embodiment of the present invention.

FIG. 1 is a cross-sectional view illustrating an example of the configuration of an image forming apparatus according to an embodiment of the present invention. A printing apparatus 100 will be described here as an example of the image forming apparatus.

The printing apparatus 100 includes an image forming section 101, a fixing section 102, a scanner section 103, a console section 104, a paper discharge section 107, a toner supply section 110, and an external sheet feed section 118. Sheet feed units 105 and 106, a conveyance unit 108, a primary transfer unit 111, a transfer belt 112, and a secondary transfer unit 113 are provided in the image forming unit 101. A switchback unit 109, a waste toner holding unit 114, fixing units 115 and 116, and conveyance units 117 and 123 are provided in the fixing section 102. A conveyance unit 119 and sheet feed units 120, 121, and 122 are provided in the external sheet feed section 118.

The scanner section 103 optically reads an original document and generates electronic data representing an image of that document. The console section 104 accepts various types of instructions for the printing apparatus 100 made by an operator. The console section 104 is provided with a display unit having touch panel functionality along with physical keys. The sheet feed units 105, 106, 120, 121, and 122 hold paper (recording material) to be printed onto by the printing apparatus 100. The paper discharge section 107 discharges the paper printed onto by the printing apparatus 100 to the exterior of the printing apparatus 100. 124 indicates a shift mechanism unit, which is a mechanism unit for realizing a shift function, described later.

In the conveyance units, rollers for conveying the paper are provided at set intervals. The switchback unit 109 inverts the output surface of the paper when the paper is discharged to the paper discharge section 107. The toner supply section 110 supplies toner, serving as a developer, to the image forming section 101. The primary transfer unit 111 transfers a toner image formed based on image data onto the transfer belt 112. The secondary transfer unit 113 transfers the toner image, transferred onto the transfer belt 112, onto paper. The waste toner holding unit 114 holds excess toner resulting from the transfer process. The fixing unit 115 fixes the toner onto the paper by applying heat and pressure to the paper onto which the image has been transferred by the secondary transfer unit 113. The fixing unit 116 reinforces the fix of the image by applying further heat and pressure to the paper onto which the image has been fixed by the fixing unit 115. The conveyance units 108, 119, and 123 form a conveyance path for conveying the paper. The conveyance unit 117 forms a conveyance path for conveying the paper from the fixing unit 115 to the fixing unit 116. The conveyance unit 123 forms a conveyance path for conveying the paper from the fixing unit 115 to the paper discharge section 107 or the switchback unit 109 without passing through the fixing unit 116. The conveyance units 108 and 119 form a conveyance path for feeding the paper from the sheet feed units 105 and 106 to the printing apparatus 100.

Figure 2:
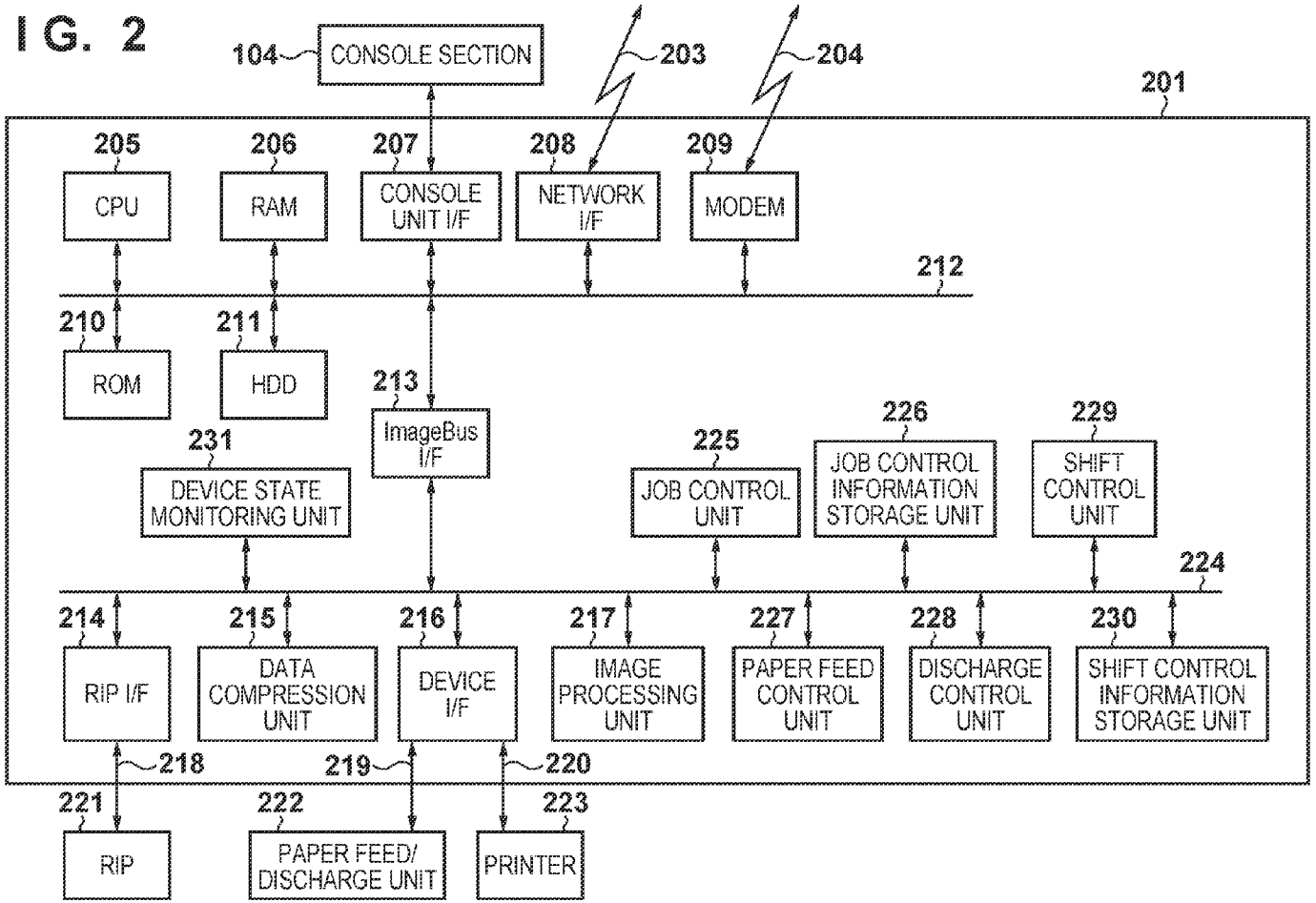
FIG. 2 is a block diagram illustrating the configuration of a main controller in a printing apparatus according to the embodiment.

FIG. 2 is a block diagram illustrating the configuration of a main controller 201 in the printing apparatus 100 according to the present embodiment.

The main controller 201 includes a CPU 205, a RAM 206, a console unit I/F 207, a network I/F 208, a modem 209, a ROM 210, and an HDD 211. These elements are connected via an image bus I/F 213 to an image bus 224 that connects a CPU bus 212, an RIP I/F 214, a data compression unit 215, a device I/F 216, and an image processing unit 217.

A network cable 203 for connecting to an external device via a network is connected to the network I/F 208. A line cable 204 for connecting to an external device over a telephone line is connected to the modem 209. The CPU 205 runs programs for controlling the main controller 201 as a whole. The RAM 206 is managed by a program run by the CPU 205. The RAM 206 is used as a receiving buffer for temporarily holding data received from the exterior, as an image memory for temporarily holding image data rasterized by a RIP 221, and so on. The ROM 210 stores programs run by the CPU 205, data, and so on. The HDD 211 is a non-volatile storage device capable of saving various types of data for long periods of time.

The console unit I/F 207 is an interface for connecting the console section 104 and the main controller 201. The RIP 221 is connected to the RIP I/F 214 via a data bus 218. The RIP 221 is a raster image processor having functionality for converting image format data input from the exterior into bitmap image data. The RIP I/F 214 is an interface for connecting the RIP 221 and the image bus 224 via the data bus 218. The data compression unit 215 compresses data.

Meanwhile, a paper feed/discharge unit 222 is connected to the device I/F 216 via a data bus 219, and a printer 223 is connected to the device I/F 216 via a data bus 220. The configuration of the printer 223 is as described above using FIG. 1. The CPU 205 issues commands for printing to the printer 223 and the paper feed/discharge unit 222 via the data buses 219 and 220 in accordance with signals supplied from the console section 104, an external device via the network cable 203, or the like. The CPU 205 also issues commands specifying discharge processes such as shifting, punching, and so on to a control apparatus included in the paper feed/discharge unit 222, based on the paper printed onto.

The image processing unit 217 executes various types of image processes on the bitmap image data generated by the RIP 221. The image processing unit 217 includes a function for processing the bitmap image data digitally, such as a function for combining two pages' worth of bitmap image data into a single page's worth of bitmap image data. A job control unit 225 analyzes data received from the exterior as a job, obtains control information such as a number of copies (a copy number; N), a paper feed designation, discharge processing information (shifting, stapling, a discharge destination), and so on, and controls the data as part of the job. A job control information storage unit 226 is a region for storing the obtained control information. A paper feed control unit 227 performs control related to paper feeding along with the CPU 205 and the job control unit 225. A discharge control unit 228 performs control related to paper discharge, on a paper-by-paper basis, along with the CPU 205 and the job control unit 225. In particular, the discharge control unit 228 issues discharge processing commands indicating processing to be performed in relation to the discharge control information, on a print paper-by-print paper basis, and manages the stated processing. A shift control unit 229 performs specialized control for the shift function along with the CPU 205, the job control unit 225, and the discharge control unit 228. A shift control information storage unit 230 holds control information necessary for managing the shift control unit 229. A device state monitoring unit 231 monitors states of the printing apparatus 100 that arise during printing, along with the CPU 205 and the job control unit 225.

Next, the shift function according to the present embodiment will be described.

The shift function is a function in which printed paper (sheets on which images have been formed) are placed in the same discharge location but are slid (shifted) by a predetermined amount (an offset value) in a direction orthogonal to a direction in which the paper is discharged. In the present embodiment, a plurality (at least four) offset values are provided, and the paper is shifted and discharged to at least four different positions.

As will be described with reference to FIGS. 3A to 3C below, the shift mechanism unit 124 can shift the discharge direction of the paper by a predetermined amount in the direction orthogonal to the discharge direction of the paper by sliding a discharge roller 125, driven by a motor (not shown), in the direction orthogonal to the discharge direction of the paper. Here, the offset values that determine the predetermined amounts are managed by a shift setting information holding table (see FIG. 5A), which is held in the shift control information storage unit 230 and will be described later.

Figure 3A:
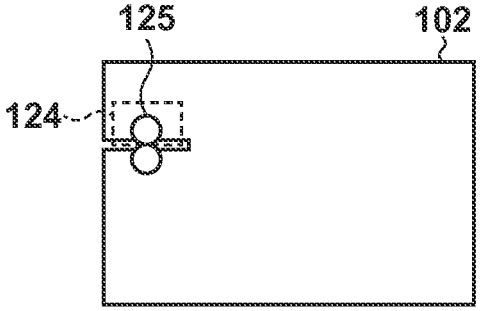
FIGS. 3A to 3C are diagrams illustrating paper being shifted and discharged by shifting the position of a discharge roller, according to the embodiment.
Figure 3B:
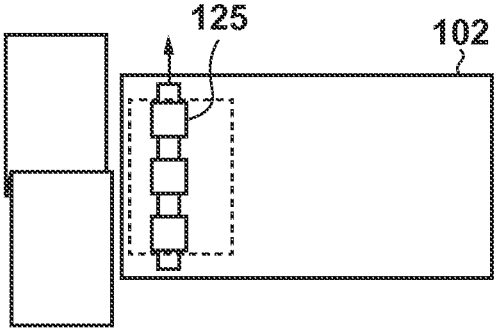
Figure 3C:
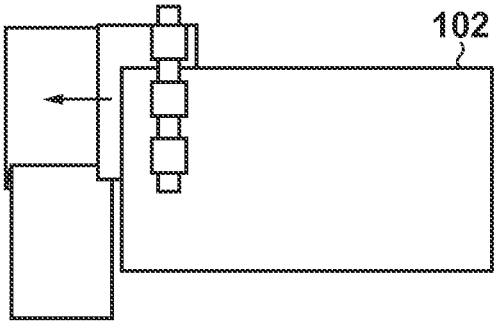

FIG. 3A is a side view of the fixing section 102, FIG. 3B is a top view of the fixing section 102, and FIG. 3C illustrates a state in which the discharge roller 125 has been shifted upward relative to the state shown in FIG. 3B. The discharge roller 125 is structured to be capable of sliding to the left and right of (in the direction orthogonal to) the conveyance direction of the paper. When the conveyed paper is received by the discharge roller 125, the discharge roller 125 is moved to a position centered on the conveyance path (an offset of 0; a shift position number 0) (FIG. 3B). After the discharge roller 125 has received the paper, the discharge roller 125 is shifted by the offset amount corresponding to the current shift position number in the shift position management table (FIG. 5B), for each piece of paper that is conveyed. To be more specific, the paper can be discharged while shifting the position of the paper in the direction orthogonal to the conveyance direction by sliding the discharge roller 125 by a predetermined amount (the offset value) to the left or right relative to the direction in which the paper advances and discharging the paper.

Figure 4:
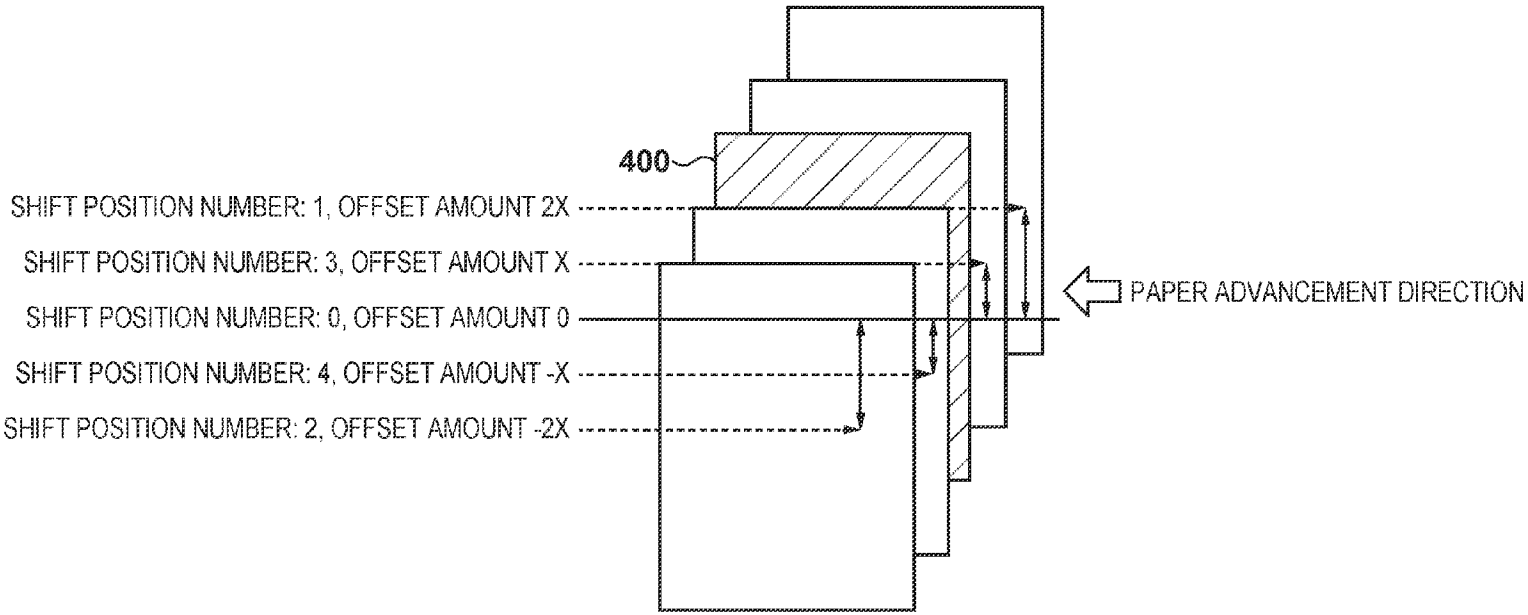
FIG. 4 is a diagram illustrating an example of the result of discharging paper shifted according to a shift position management table (FIG. 5B) according to the embodiment.

FIG. 4 is a diagram illustrating an example of the result of discharging paper shifted according to the shift position management table (FIG. 5B) according to the embodiment.

In FIG. 4, 400 indicates a discharge position in the case where the offset amount is 0. Discharge positions whose offset amounts are X, 2X, −X, and −2X relative to the offset amount of 0 are also indicated.

The shift position management table shown in FIG. 5B is a table indicating sets of shift position numbers that uniquely indicate shift positions and corresponding offset amounts (position information). Here, an offset amount is negative when corresponding to the left direction relative to the direction in which paper advances along the conveyance path, and positive when corresponding to the right direction. Although shift position numbers 1 to 4 are set to be essentially horizontally symmetrical relative to the offset amount of 0 (no shift) here, the present invention is not limited thereto.

The shift setting information holding table in FIG. 5A is an example of a management table held in the shift control information storage unit 230. The shift setting information holding table is used to hold and manage current and past information related to shift settings, including a currently-set shift position number (current shift position setting information), a previously-used job-to-job shift position number, and a previously-used copy-to-copy shift position number.

FIG. 5C illustrates an example of a shift group management table. This table is a table for managing a plurality of shift positions in the shift position management table as a group. A shift position group used only in job-to-job shifts, a group used when job-to-job and copy-to-copy shifts are used simultaneously, a group used only in copy-to-copy shifts, and so on are assigned and managed in the shift group management table. In FIG. 5C, the position numbers used only in job-to-job shifts are "1" and "2", and the groups used when job-to-job and copy-to-copy shifts are used simultaneously are "1 and 3" and "2 and 4". The group used only in copy-to-copy shifts is "3 and 4".

First Working Example

First, a first working example of the present invention will be described.

Figure 6:
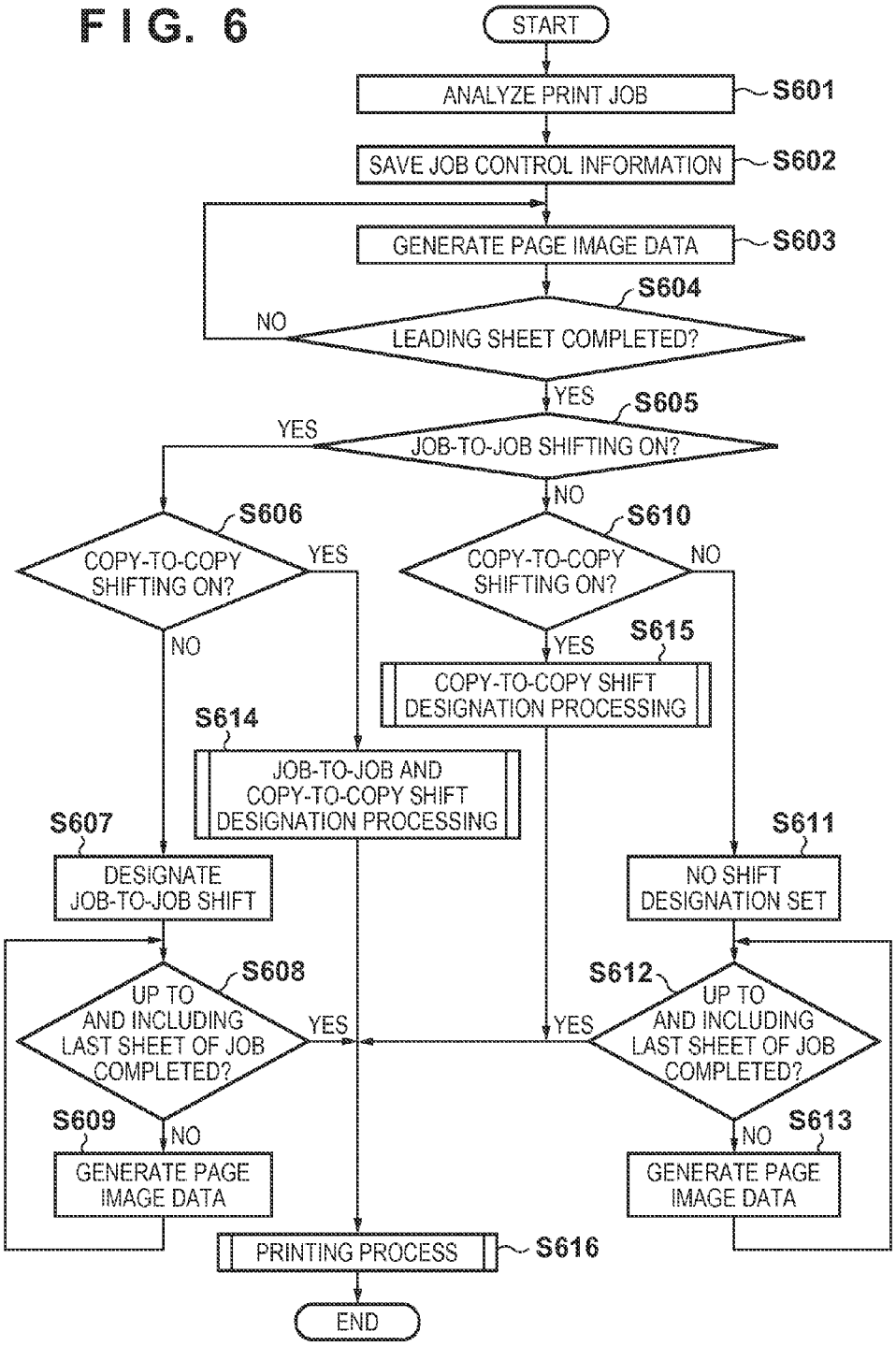
FIG. 6 is a flowchart illustrating a control process carried out by the main controller in the printing apparatus according to a first working example.

FIG. 6 is a flowchart illustrating a control process carried out by the main controller 201 in the printing apparatus 100 according to the first working example. The programs that execute this processing are stored in the ROM 210 and are executed under the control of the CPU 205.

First, in S601, upon receiving a print job, the CPU 205 analyzes the received job and obtains control information such as the number of copies (a copy number; N), shift designations (job-to-job, copy-to-copy), a paper feed designation, discharge processing information (stapling, discharge destination), and so on. Then, in S602, the CPU 205 saves the obtained information in the job control information storage unit 226. Next, in S603, the CPU 205 generates rasterized image data for each page that is to be printed using the RIP 221, and saves the image data in the RAM 206. Then, in S604, the CPU 205 determines whether or not rasterized image data has been generated up to and including the leading sheet of the print job. In the case where it is determined that up to and including the leading sheet has been rasterized, the process advances to S605, where the CPU 205 determines whether or not job-to-job shifting is designated based on the information saved in the job control information storage unit 226. In the case where it is determined that job-to-job shifting is designated, the process advances to S606, where the CPU 205 determines whether or not copy-to-copy shifting is designated based on the information saved in the job control information storage unit 226. In the case where copy-to-copy shifting is not designated, the process advances to S607, where the CPU 205 sets the job-to-job shift designation in the discharge control information related to the leading sheet and saves the setting in the RAM 206. Then, in S608, the CPU 205 determines whether or not rasterized image data has been generated up to and including the final sheet of the print job, and the process advances to S609 in the case where the process is not complete for up to and including the final sheet. In S609, the CPU 205 generates the image data for the next page, and the process advances to S608. In this manner, the RIP 221 generates the rasterized image data for each page to be printed in S608, and the process advances to S616 when up to and including the final page of the print job has been saved in the RAM 206. In S616, the CPU 205 prints all of the copies designated in the print job based on the rasterized image data and the discharge control information saved in the RAM 206.

On the other hand, in the case where it is determined in S606 that copy-to-copy shifting is designated, the process advances to S614, where designating processing for both job-to-job and copy-to-copy shifting is carried out.

Figure 7:
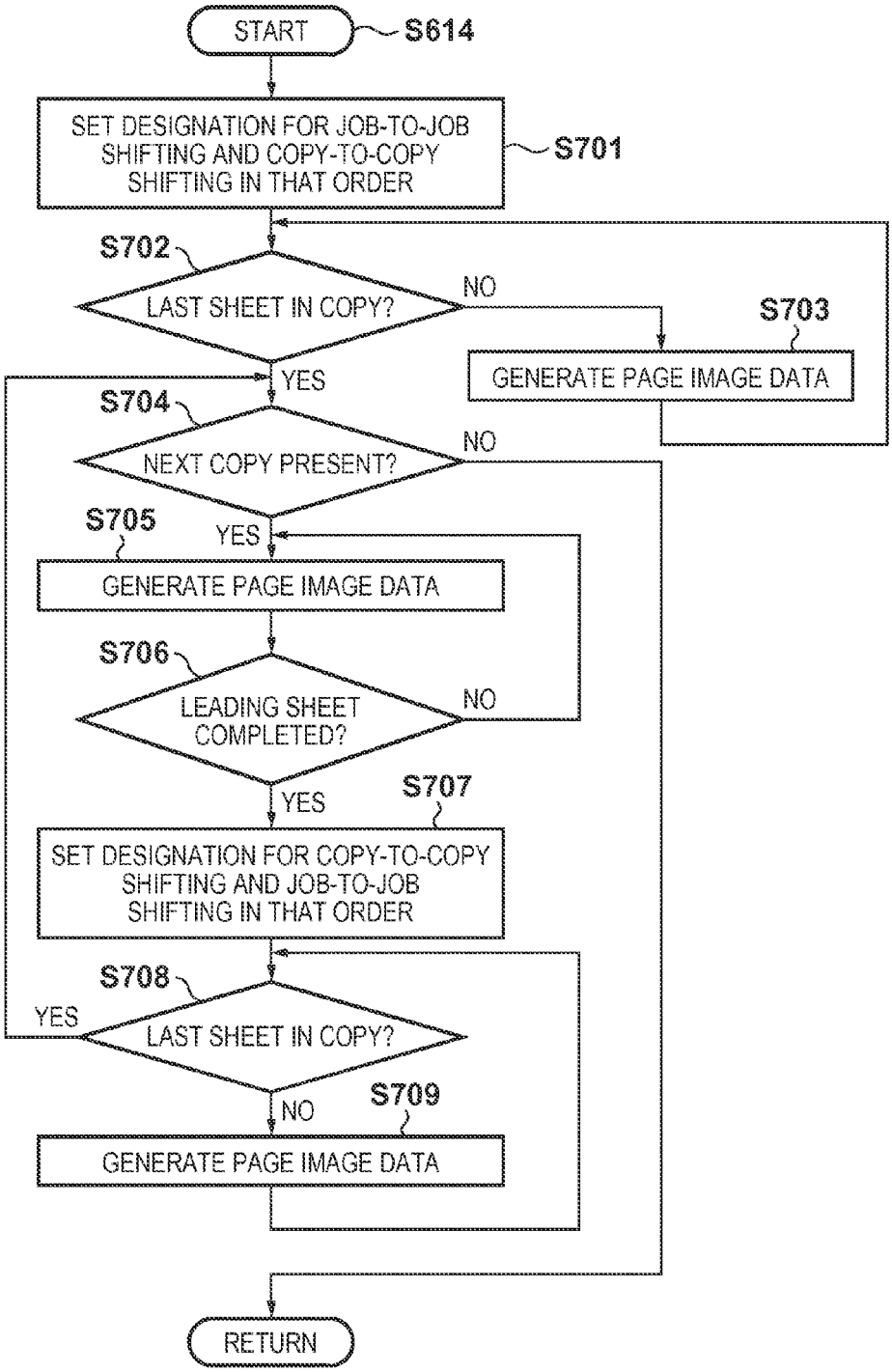
FIG. 7 is a flowchart illustrating job-to-job and copy-to-copy shift designating processing, carried out in S614 of FIG. 6.

FIG. 7 is a flowchart illustrating the job-to-job and copy-to-copy shift designating processing, carried out in S614 of FIG. 6.

First, in S701, the CPU 205 sets a designation for job-to-job shifting and copy-to-copy shifting, in that order, in the discharge control information related to the leading sheet, and saves the information in the RAM 206. Then, in S702, the CPU 205 determines whether or not rasterized image data has been generated for the last sheet of the copy. In the case where it is determined that the rasterized image data has not been generated for the last sheet of the copy, the process advances to S703, where the RIP 221 generates the rasterized image data for the next page to be printed and saves the data in the RAM 206, after which the process returns to S702. In S702, in the case where the CPU 205 determines that the rasterized image data has been generated up to and including the last sheet of the copy, the process advances to S704, where the CPU 205 determines whether or not there is a next copy. In the case where it is determined that there is no copy to be processed, the process advances to S616 of FIG. 6, where all of the copies designated in the print job are printed based on the rasterized image data and the discharge control information saved in the RAM 206 during the printing process.

On the other hand, in the case where it is determined in S704 that there is a next copy to be processed, the process advances to S705, where the CPU 205 generates rasterized image data for each page using the RIP 221 and saves the data in the RAM 206. Then, in S706, the CPU 205 determines whether or not rasterized image data has been generated up to and including the leading sheet of the copy. In the case where it is determined that up to and including the leading sheet has been completed, the process advances to S707, where the CPU 205 sets a designation for copy-to-copy shifting and job-to-job shifting, in that order, in the discharge control information related to the leading sheet of the copy, and saves the information in the RAM 206. Then, in S708, the CPU 205 determines whether or not rasterized image data has been generated for the last sheet of the copy, and in the case where it is determined that the rasterized image data has been generated up to and including the last sheet of the copy, the process returns to S704 and the aforementioned processing is carried out. On the other hand, in S708, in the case where it is determined that the rasterized image data has not been generated for the last sheet of the copy, the process advances to S709, where the CPU 205 generates the rasterized image data for the next page to be printed using the RIP 221 and saves the data in the RAM 206, after which the process returns to S708.

Returning once again to FIG. 6, in the case where it is determined in S605 that job-to-job shifting is not designated, the process advances to S610. In S610, the CPU 205 determines whether or not copy-to-copy shifting is designated based on the information saved in the job control information storage unit 226. In the case where copy-to-copy shifting is not designated, the process advances to S611, where under the control of the shift control unit 229, the CPU 205 sets the discharge control information associated with the image data of the leading sheet to "no shift designation" and saves the setting in the RAM 206. Then, in S612 and S613, the RIP 221 generates rasterized image data for each page to be printed, up to and including the last sheet of the job, and saves the data in the RAM 206. Then, in S616, all of the copies designated in the print job are printed based on the rasterized image data and the discharge control information saved in the RAM 206.

In the case where the CPU 205 determines in S610 that copy-to-copy shifting is designated, the process advances to S615, where the copy-to-copy shift designating processing is carried out. Details of this process will be described given with reference to the flowchart in FIG. 8.

Figure 8:
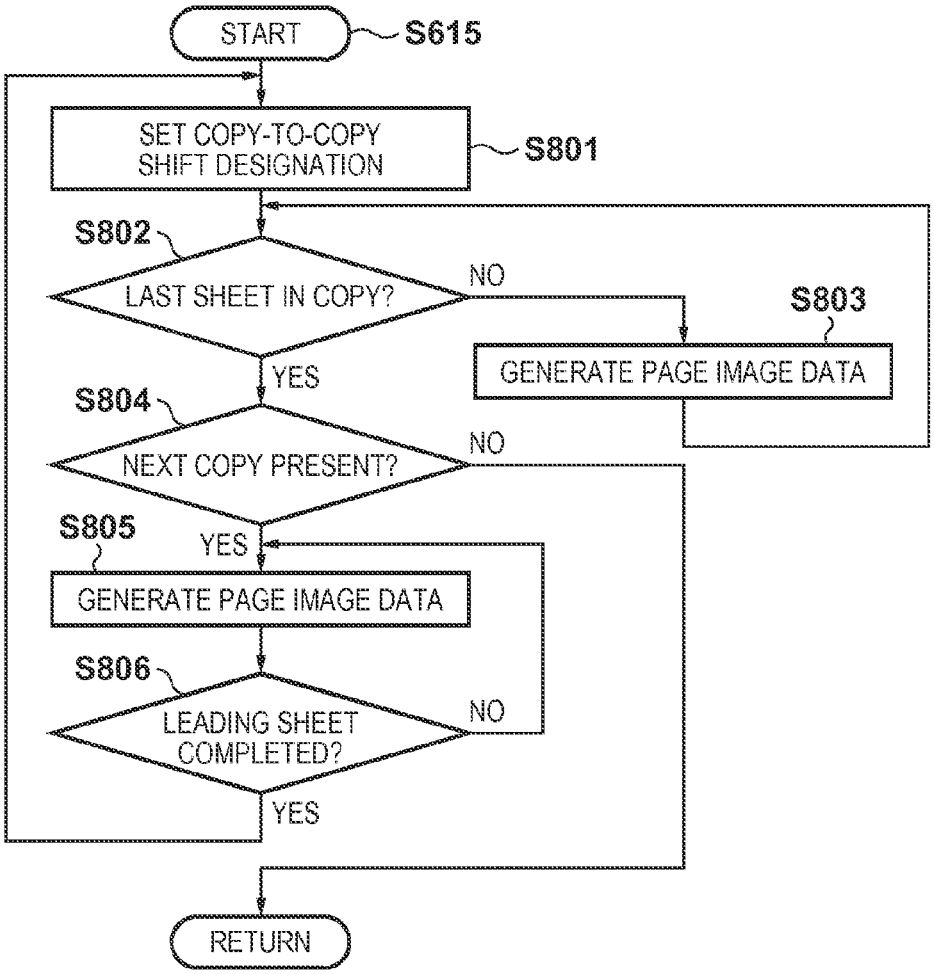
FIG. 8 is a flowchart illustrating copy-to-copy shift designating processing, carried out in S615 of FIG. 6.

FIG. 8 is a flowchart illustrating copy-to-copy shift designating processing, carried out in S615 of FIG. 6.

First, in S801, the CPU 205 sets a designation for copy-to-copy shifting in the discharge control information related to the leading sheet, and saves the information in the RAM 206. Then, in S802, the CPU 205 determines whether or not rasterized image data has been generated for the last sheet of the copy, using the job control unit 225. In the case where it is determined that the rasterized image data has not been generated for the last sheet of the copy, the process advances to S803, where the CPU 205 generates rasterized image data for the next page to be printed using the RIP 221 and saves the data in the RAM 206, after which the process returns to S802. In this manner, when it is determined that the rasterized image data has been generated for the last sheet of the copy in S802, the process advances to S804, where the CPU 205 determines whether or not there is a next copy. In the case where it is determined that there is no copy to be processed, the process advances to S616 of FIG. 6, where all of the copies are printed based on the rasterized image data and the discharge control information saved in the RAM 206.

On the other hand, in the case where it is determined in S804 that there is a next copy to be processed, the process advances to S805, where the CPU 205 generates rasterized image data for each page to be printed using the RIP 221 and saves the data in the RAM 206. Then, in S806, the CPU 205 determines whether or not rasterized image data has been generated up to and including the leading sheet of the copy, using the job control unit 225. In the case where the image data has been generated up to and including the leading sheet, the process returns to S801, where the CPU 205 sets a designation for copy-to-copy shifting in the discharge control information related to the leading sheet of the copy, and saves the information in the RAM 206.

Next, details of control carried out in the shift control process performed during the printing process will be described using the flowchart illustrated in FIG. 9.

Figure 9:
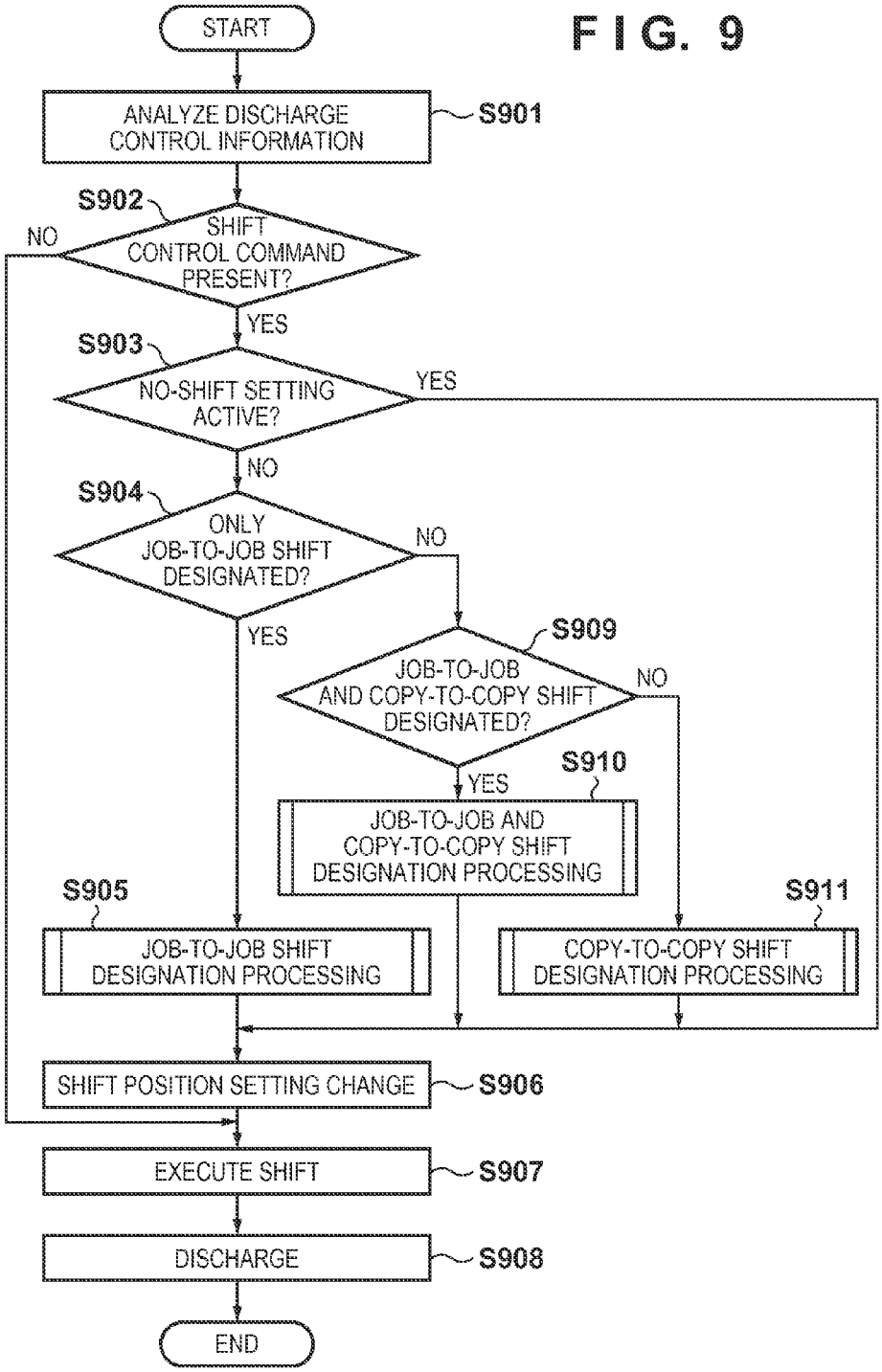
FIG. 9 is a flowchart illustrating a shift control process carried out by the main controller in the printing apparatus according to the first working example.

FIG. 9 is a flowchart illustrating a shift control process carried out by the main controller 201 in the printing apparatus 100 according to the first working example. The programs that execute this processing are stored in the ROM 210 and are executed under the control of the CPU 205.

In S901, the CPU 205 analyzes the discharge control information, added by the discharge control unit 228, that designates discharge processing related to each sheet of paper. Then, in S902, the CPU 205 determines whether or not a shift control command is set. In the case where the shift control command is not set, the process advances to S907, where shifting is executed using the current shift position settings, without changing the current shift position number in the shift setting information holding table (FIG. 5A). Then, in S908, the paper is shifted and discharged.

On the other hand, in the case where it is determined in S902 that the shift control command is set, the process advances to S903, where the CPU 205 determines whether or not a no-shift setting is active. In the case where the no-shift setting is active, the process advances to S906, where a shift position number of 0, indicating no shift, is set as the current shift position number in the shift setting information holding table (FIG. 5A), after which the process advances to S907.

On the other hand, in the case where it is determined in S902 that the no-shift setting is not active, the process advances to S904, where the CPU 205 determines whether or not only a job-to-job shift setting is active. In the case where only the job-to-job shift setting is active, the process advances to S905, where the job-to-job shift designating processing is carried out.

Figure 10:
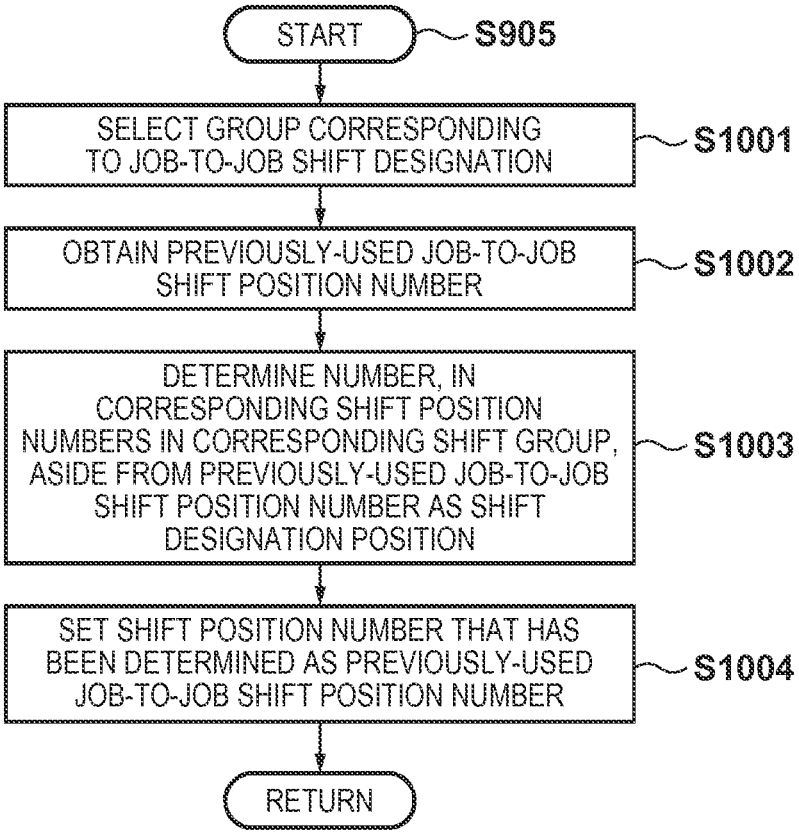
FIG. 10 is a flowchart illustrating job-to-job shift designating processing, carried out in S905 of FIG. 9.

FIG. 10 is a flowchart illustrating the job-to-job shift designating processing, carried out in S905 of FIG. 9.

First, in S1001, the CPU 205 selects, from the shift group management table (FIG. 5C), a group (job) corresponding only to a job-to-job shift. In the example shown in FIG. 5C, the corresponding position number group is "1 and 2". Then, in S1002, the CPU 205 obtains the previously-used job-to-job shift position number from the shift setting information holding table (FIG. 5A). Then, in S1003, a number, in the corresponding shift position numbers in the shift group selected in S1001 ("1 and 2" in FIG. 5C), aside from the previously-used job-to-job shift position number, is determined as the next shift position. Based on the examples in FIGS. 5A and 5C, the shift position is determined as "2". Then, in S1004, the shift position number that has been determined ("2" in this case) is set and saved as the previously-used job-to-job shift position number in the shift setting information holding table (FIG. 5A) by the CPU 205.

The process then advances to S906 in FIG. 9, where the CPU 205 changes the shift position setting by saving the determined shift position number as the current shift position number in the shift setting information holding table (FIG. 5A). The process then advances to S907, where the shift is executed, and in S909, the paper is shifted and discharged.

Meanwhile, in the case where it is determined in S904 that only a job-to-job shift setting is not active, the process advances to S909. The CPU 205 then determines whether or not both a job-to-job shift and a copy-to-copy shift are set. In the case where both shifts are set, the process advances to S910, where the job-to-job and copy-to-copy shift designating processing are carried out.

FIG. 11 is a flowchart illustrating job-to-job and copy-to-copy shift designating processing, carried out in S910 of FIG. 9.

First, in S1101, the CPU 205 determines whether the job-to-job shift has been set first. In the case where the job-to-job shift has been set first, the process advances to S1102, where the CPU 205 obtains the previously-used job-to-job shift position number by referring to the shift setting information holding table (FIG. 5A). Then, in S1103, the CPU 205 determines a group, among the groups from the shift group management table (FIG. 5C) that correspond to both a job-to-job shift and a copy-to-copy shift, that does not include the obtained shift position number, as a corresponding shift group. Then, in S1104, the CPU 205 determines the job-to-job shift position number included in a corresponding shift number of the corresponding shift group as a shift designation position. Then, in S1105, the CPU 205 saves the determined shift position number as the previously-used job-to-job shift position number in the shift setting information holding table (FIG. 5A). The process then advances to S906 in FIG. 9, where the CPU 205 changes the shift position setting by saving the determined shift position number as the current shift position number in the shift setting information holding table (FIG. 5A). Then, in S907, the shift is executed, and in S908, the paper is shifted and discharged.

Meanwhile, in the case where it is determined in S1101 of FIG. 11 that the job-to-job shift setting was made after the copy-to-copy shift setting, the process advances to S1106. The CPU 205 then obtains the previously-used job-to-job shift position number from the shift setting information holding table (FIG. 5A). Then, in S1107, the CPU 205 determines a group, among the groups from the shift group management table (FIG. 5C) that correspond to both a job-to-job shift and a copy-to-copy shift, that includes the obtained shift position number, as the corresponding shift group. Then, in S1108, the CPU 205 obtains the current shift position number from the shift setting information holding table (FIG. 5A). Then, in S1109, the CPU 205 determines a position number, among the corresponding shift numbers of the corresponding shift group, that is not the current shift position number, as the shift designation position. Then, in S1110, the CPU 205 refers to the shift group management table (FIG. 5C), and determines whether the shift position number determined in S1109 indicates a job-to-job group. In the case where the shift position number indicates the job-to-job group, the process advances to S1111, where the CPU 205 saves the determined shift position number as the previously-used job-to-job shift position number in the shift setting information holding table (FIG. 5A). On the other hand, in the case where the shift position number does not indicate the job-to-job group in S1110, the process advances to S1112, where the CPU 205 saves the determined shift position number as the previously-used copy-to-copy shift position number in the shift setting information holding table (FIG. 5A). The process then advances to S906 in FIG. 9, where the CPU 205 changes the shift position setting by saving the determined shift position number as the current shift position number in the shift setting information holding table (FIG. 5A). Then, in S907, the shift is executed, and in S908, the paper is shifted and discharged. Meanwhile, in the case where both the job-to-job shift and the copy-to-copy shift are not set in S909 of FIG. 9, the process advances to S911, where copy-to-copy shift setting processing is carried out.

Figure 12:
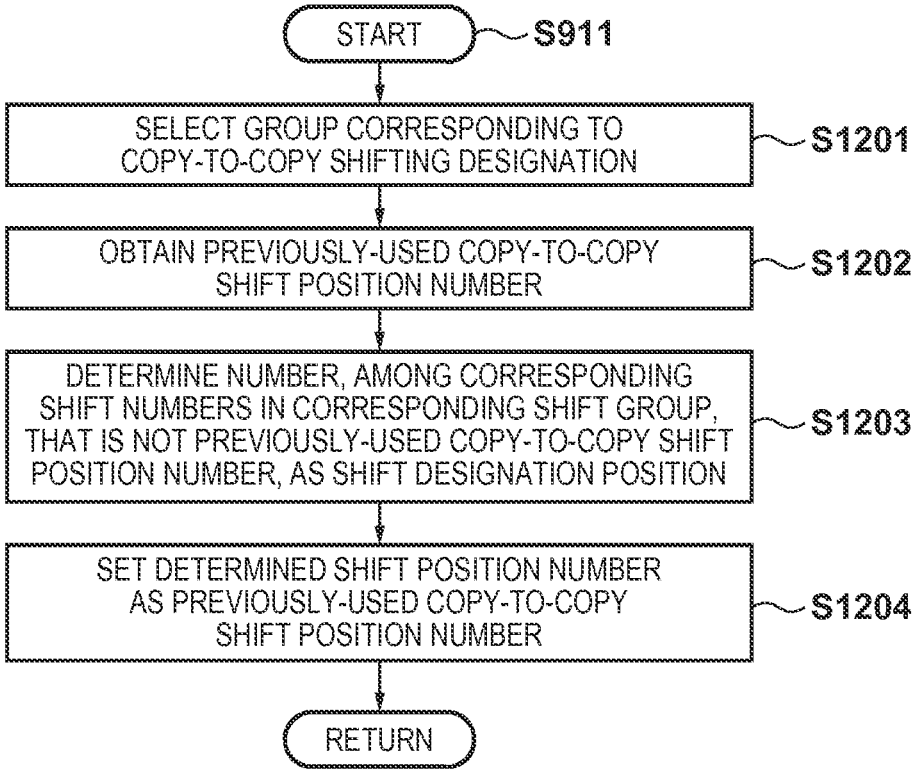
FIG. 12 is a flowchart illustrating setting processing for copy-to-copy shifts, carried out in S911 of FIG. 9.

FIG. 12 is a flowchart illustrating the copy-to-copy shift setting processing carried out in S911 of FIG. 9. First, in S1201, the CPU 205 selects, from the shift group management table (FIG. 5C), a group corresponding only to copy-to-copy shifting. Then, in S1202, the CPU 205 obtains the previously-used copy-to-copy shift position number from the shift setting information holding table (FIG. 5A). Then, in S1203, a number, among the shift position numbers corresponding to the shift group selected in S1201, that is not the previously-used copy-to-copy shift position number ("4", the examples of FIGS. 5A to 5C) is determined as the shift designation. Then, in S1204, the CPU 205 saves the shift position number determined in S1203 as the final copy-to-copy shift position number in the shift setting information holding table (FIG. 5A). The process then advances to S906 in FIG. 9, where the CPU 205 changes the shift designation position by saving the determined shift position number as the current shift position number in the shift setting information holding table (FIG. 5A). Then, in S907, the shift is executed, and in S908, the paper is shifted and discharged.

In this manner, according to the first working example, when executing a first job, a single group (for example, "1 and 3") is selected from among a plurality of groups, and printed sheets are shifted and discharged, for each copy of the first job, in accordance with a plurality of pieces of position information included in the selected group. Then, when executing a second job that follows the first job, another group (for example, "2 and 4") is selected from among the plurality of groups, and printed sheets are shifted and discharged, for each copy of the second job, in accordance with a plurality of pieces of position information included in the selected group ("2 and 4"). As a result, left and right discharge positions are split into groups on a job-by-job basis, and the sheets are discharged after changing the shift positions for each copy within the group.

According to the present first working example as described thus far, a shift function capable of changing among a plurality (at least four) discharge positions can be executed in the case where a print job in which both job-to-job shifting and copy-to-copy shifting are designated has been loaded. As a result, the paper can be discharged at different shift positions from print job to print job and from copy to copy within a single job, making it easy to identify printed sheets on a job-by-job basis and a copy-by-copy basis.

Second Working Example

Next, a second working example of the present invention will be described.

The second working example describes an example in which printed sheets are shifted and discharged so that in addition to the job-to-job and copy-to-copy shifting described in the aforementioned first working example, shifts are carried out for each of chapters included in a print job (called "chapter-to-chapter shifting" hereinafter) so that the three types of printed material can be distinguished from one another. Note that the configuration of the printing apparatus 100 and the hardware configuration of the image forming apparatus according to the second working example are the same as those in the first working example, and thus descriptions thereof will be omitted.

FIG. 13A is a diagram illustrating an example of the shift setting information holding table according to the present second working example.

This shift setting information holding table is held in the shift control information storage unit 230. A currently-set shift position number (a current shift position number), the previously-used job-to-job shift position number, and previously-used copy-to-copy and chapter-to-chapter shift position numbers are registered and managed in the table.

FIG. 13B is a diagram illustrating an example of the shift group management table according to the second working example.

This table is a table for managing a plurality of shift positions in the shift position management table (FIG. 5B) as a group. This management table is used to manage the grouping of shift positions into a job-to-job shift position group used only for job-to-job shifting and a group in which job-to-job shifting, copy-to-copy shifting, and chapter-to-chapter shifting are carried out in parallel.

Figure 14:
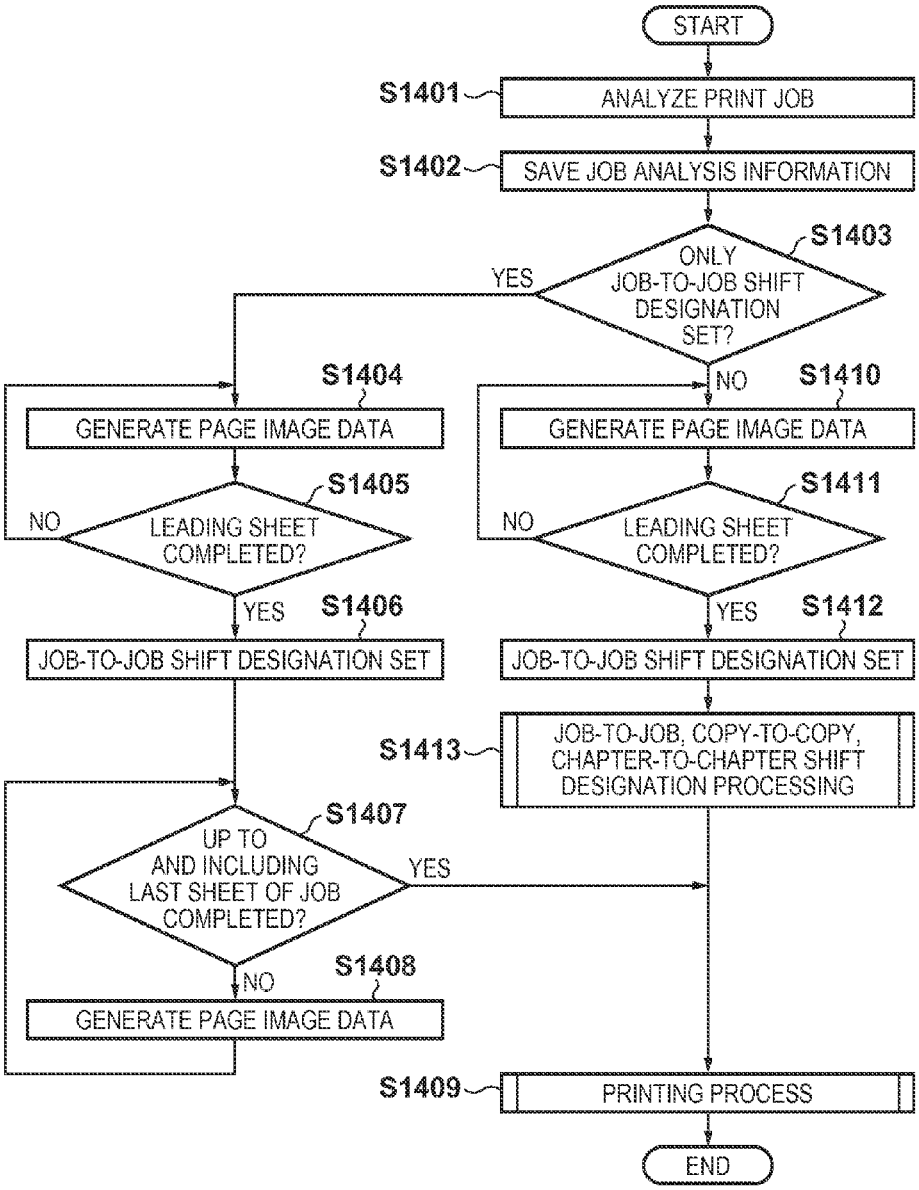
FIG. 14 is a flowchart illustrating a control process carried out by the main controller in the printing apparatus according to the second working example.

FIG. 14 is a flowchart illustrating a control process carried out by the main controller 201 in the printing apparatus 100 according to the second working example. The programs that execute this processing are stored in the ROM 210 and are executed under the control of the CPU 205.

First, in S1401, when a print job is received, the CPU 205 analyzes the received job along with the job control unit 225 and obtains control information as described below. A number of copies (copy number; N), a shift designation (job-to-job, copy-to-copy, chapter-to-chapter shift), a paper feed designation, discharge processing information (stapling, discharge destination), and so on are obtained as the information. Then, in S1402, the CPU 205 saves the obtained information in the job control information storage unit 226. Then, in S1403, the CPU 205 determines whether or not only a job-to-job shift is designated, based on the information saved in the job control information storage unit 226. Here, in the case where it is determined that only a job-to-job shift is designated, the process advances to S1404, where the RIP 221 generates rasterized image data for each page to be printed and saves the data in the RAM 206. Then, in S1405, the CPU 205 determines whether or not rasterized image data has been generated up to and including the leading sheet of the print job. In the case where the image data has been generated up to and including the leading sheet, the process advances to S1406, where the CPU 205 sets a designation for job-to-job shifting in the discharge control information related to the leading sheet, and saves the information in the RAM 206. In S1408, the RIP 221 generates rasterized image data on a page-by-page basis and stores the data in the RAM 206 until it is determined in S1407 that the image data has been generated up to and including the final page of the job. When it is determined in S1407 that the image data has been generated up to and including the last page of the job, the process advances to S1409. In S1409, the CPU 205 prints all of the copies designated in the print job based on the rasterized image data and the discharge control information saved in the RAM 206.

On the other hand, in the case where it is determined in S1403 that there is a designation for a shift aside from job-to-job shifting, the process advances to S1410, where the RIP 221 generates rasterized image data for each page and saves the data in the RAM 206. Then, in S1411, the CPU 205 determines whether or not rasterized image data has been generated up to and including the leading sheet of the print job, and when up to and including the leading sheet has been rasterized, the process advances to S1412. In S1412, the CPU 205 sets a designation for job-to-job shifting in the discharge control information related to the leading sheet, and saves the information in the RAM 206. The process then advances to S1413, where job-to-job, copy-to-copy, and chapter-to-chapter shift designating processing is carried out.

Figure 15:
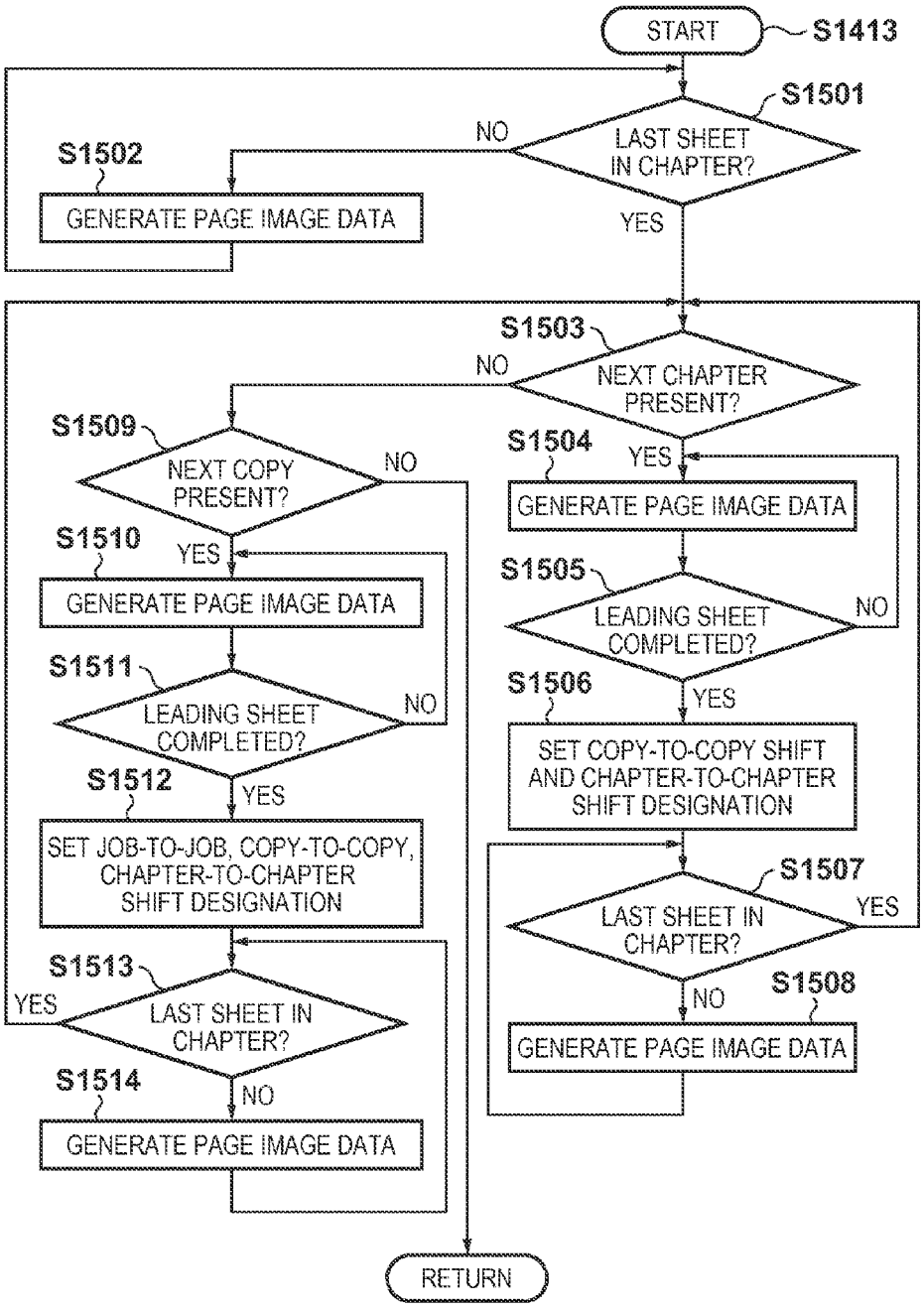
FIG. 15 is a flowchart illustrating processing carried out in S1413 of FIG. 14.

FIG. 15 is a flowchart illustrating processing carried out in S1413 of FIG. 14.

In S1501, the CPU 205 determines whether or not rasterized image data has been generated for the last sheet of a chapter. In the case where the rasterized image data has not been generated for the last sheet of the chapter, the process advances to S1502, where the RIP 221 generates the rasterized image data for each page; the process then advances to S1501, where up to and including the last sheet of the chapter are saved in the RAM 206. In this manner, when it is determined that the rasterized image data has been generated up to and including the last sheet of the chapter, the process advances to S1503, where the CPU 205 determines whether or not there is a next chapter. In the case where it is determined that there is a next chapter, the process advances to S1504, where the RIP 221 generates rasterized image data for each page and saves the data in the RAM 206. Then, in S1505, the CPU 205 determines whether or not rasterized image data has been generated up to and including the leading sheet of the chapter. When the rasterized image data is generated for up to and including the leading sheet of the chapter in this manner, the process advances to S1506, where the CPU 205 sets a copy-to-copy shifting and chapter-to-chapter shifting designation in the discharge control information related to the leading sheet of the chapter and saves the information in the RAM 206. Then, in S1507, the CPU 205 determines whether or not rasterized image data has been generated up to and including the last sheet of the chapter, and the process advances to S1508 in the case where the rasterized image data has not been generated for the last sheet of the chapter. In S1508, the CPU 205 generates the rasterized image data for each page using the RIP 221 and saves the data in the RAM 206, after which the process returns to S1507. When the rasterized image data is generated for each page up to and including the last sheet of the chapter and saved in the RAM 206 in this manner, the process returns to S1503 from S1507.

On the other hand, in the case where the CPU 205 determines in S1503 that there is no next chapter, the process advances to S1509, where the CPU 205 determines whether or not there is a next copy. In the case where it is determined that there is no next copy, the process returns to S1409 of FIG. 14, where all of the copies designated in the print job are printed based on the rasterized image data and the discharge control information saved in the RAM 206. On the other hand, in the case where it is determined in S1509 that there is a next copy to be processed, the process advances to S1510, where the RIP 221 generates rasterized image data for each page and saves the data in the RAM 206. Then, in S1511, the CPU 205 determines whether or not rasterized image data has been generated up to and including the leading sheet of the copy, and when up to and including the leading sheet has been rasterized, the process advances to S1512. In S1512, the CPU 205 sets a designation for job-to-job shifting, copy-to-copy shifting, and chapter-to-chapter shifting in the discharge control information related to the leading sheet of the copy, and saves the information in the RAM 206. Then, in S1513, the CPU 205 determines whether or not rasterized image data has been generated for the last sheet of the chapter. In the case where the rasterized image data has not been generated for the last sheet of the chapter, the process advances to S1514, where the RIP 221 generates the rasterized image data for each page and saves the data in the RAM 206, after which the process returns to S1513. In this manner, when the CPU 205 determines in S1513 that the rasterized image data has been generated up to and including the last sheet of the chapter, the process returns to S1503, where the same processing as described above is executed.

Figure 16:
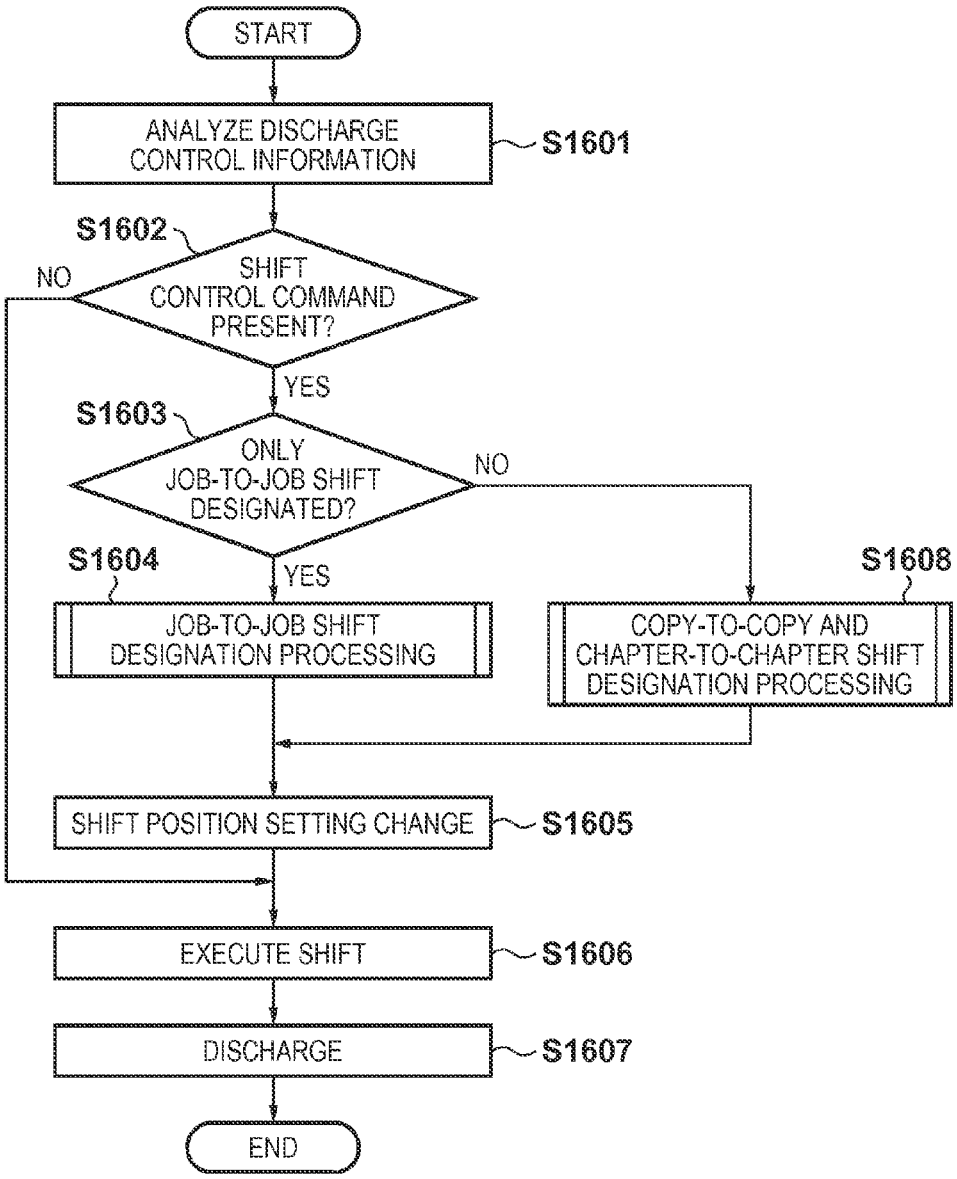
FIG. 16 is a flowchart illustrating a shift control process carried out by the main controller in the printing apparatus according to the second working example.

FIG. 16 is a flowchart illustrating a shift control process carried out by the main controller 201 in the printing apparatus 100 according to the second working example. The programs that execute this processing are stored in the ROM 210 and are executed under the control of the CPU 205.

First, in S1601, the CPU 205 analyzes the discharge control information, added by the discharge control unit 228, that designates discharge processing related to each sheet of paper. Then, in S1602, the CPU 205 determines whether or not a shift control command is set. In the case where it is determined that the shift control command is not set, the process advances to S1606, where shifting is executed using the current shift position settings, without changing the current shift position number in the shift setting information holding table (FIG. 13A). Then, in S1607, the paper is shifted and discharged.

On the other hand, in the case where it is determined in S1602 that the shift control command is set, the process advances to S1603, where the CPU 205 determines whether or not only a job-to-job shift setting is active. In the case where only the job-to-job shifting is designated, the process advances to S1604, where the CPU 205 carries out the job-to-job shift designating processing.

Figure 17:
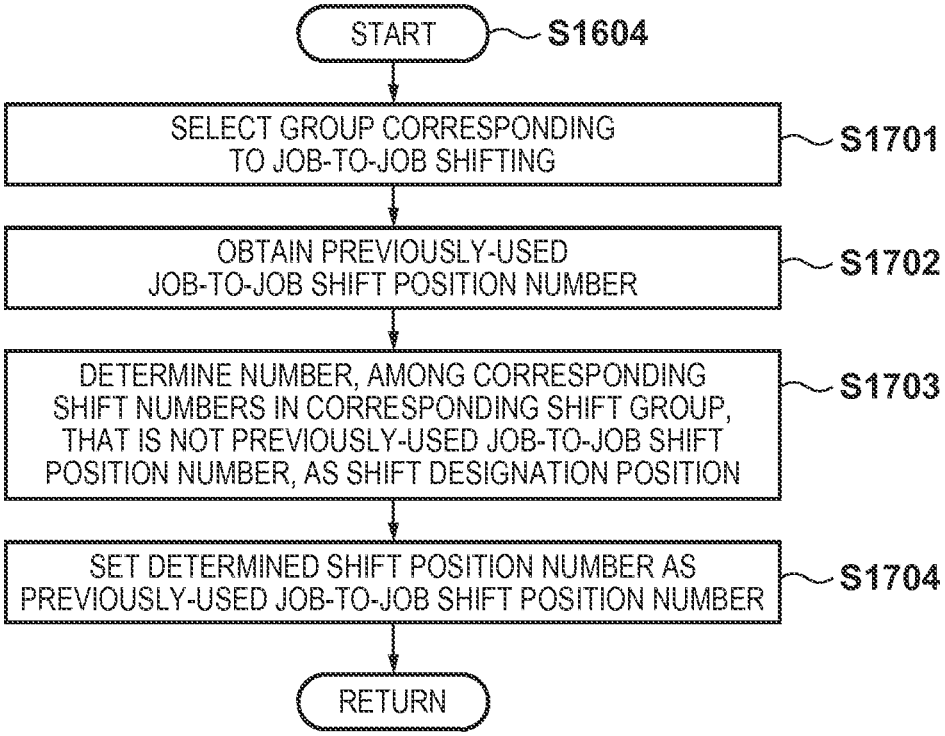
FIG. 17 is a flowchart illustrating job-to-job shift designating processing, carried out in S1604 of FIG. 16.

FIG. 17 is a flowchart illustrating the job-to-job shift designating processing, carried out in S1604 of FIG. 16.

First, in S1701, the CPU 205 selects, from the shift group management table (FIG. 13B), a group (job) corresponding only to a job-to-job shift. Then, in S1702, the CPU 205 obtains the previously-used job-to-job shift position number from the shift setting information holding table (FIG. 13A). Then, in S1703, a number, among the corresponding shift numbers in the shift group selected in S1701, that is not the previously-used job-to-job shift position number is determined as the shift designation. Then, in S1704, the CPU 205 saves the determined shift position number as the previously-used job-to-job shift position number in the shift setting information holding table (FIG. 13A). The process then returns to S1605 in FIG. 16, where the CPU 205 changes the shift position setting by saving the determined shift position number as the current shift position number in the shift setting information holding table (FIG. 13A). Then, in S1606, the shift is executed, and in S1607, the paper is shifted and discharged.

Meanwhile, in the case where not only the job-to-job shifting is designated in S1603 of FIG. 16, the process advances to S1608, where the CPU 205 carries out the copy-to-copy shift and chapter-to-chapter shift designating processing.

Figure 18A:
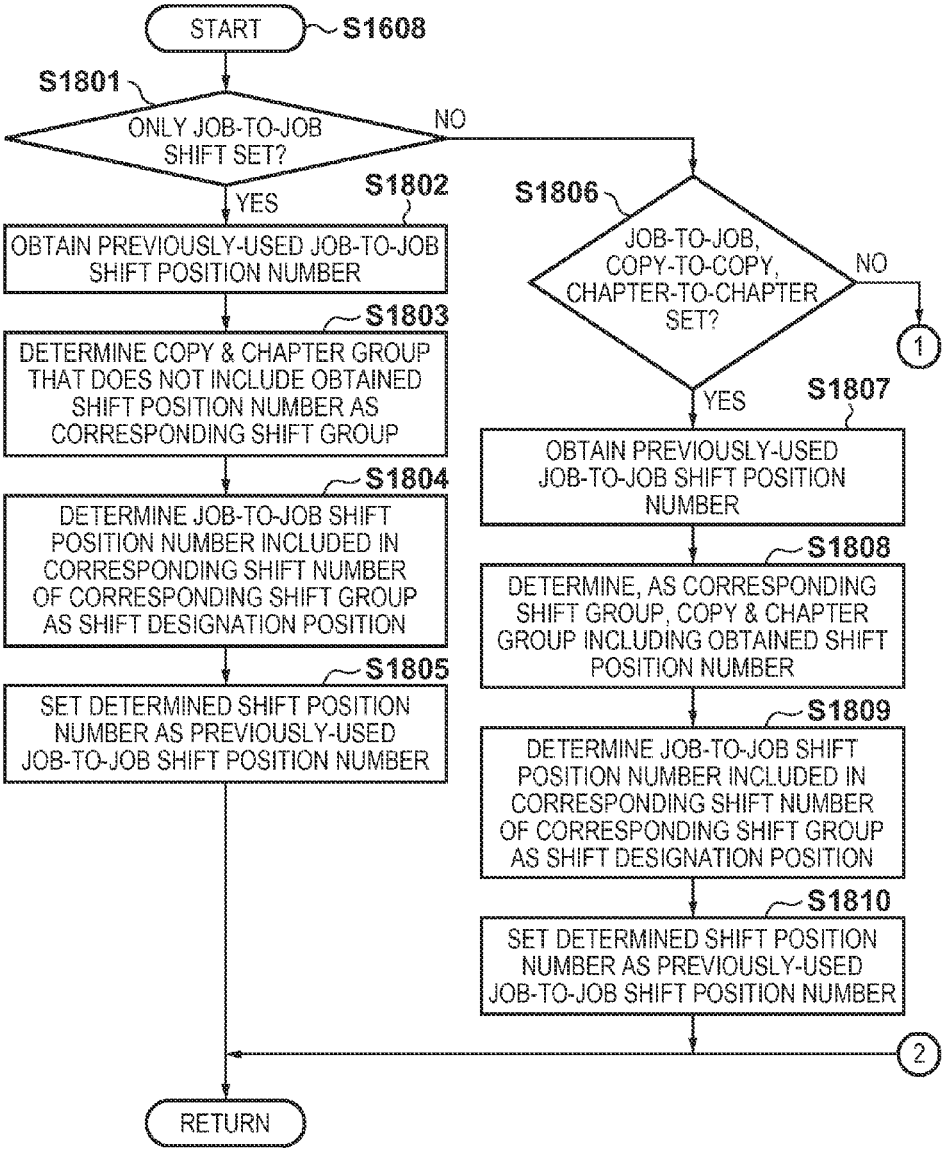
FIGS. 18A and 18B are flowcharts illustrating copy-to-copy and chapter-to-chapter shift designating processing, carried out in S1608 of FIG. 16.
Figure 18B:
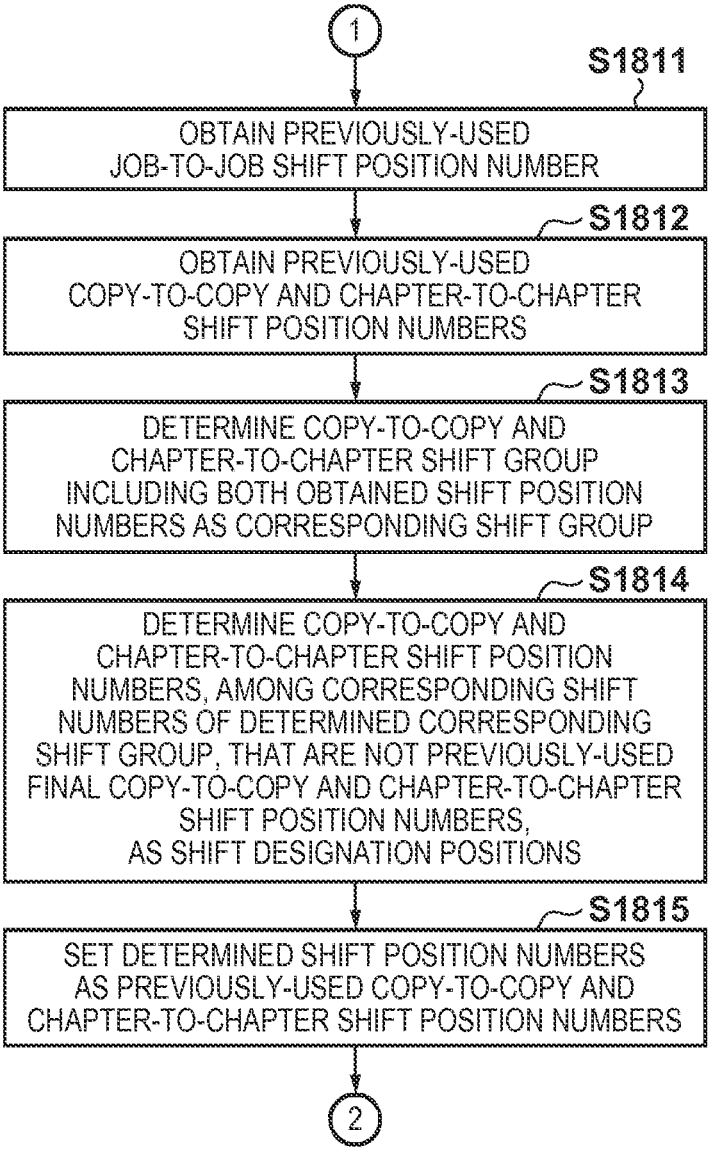

FIGS. 18A and 18B are flowcharts illustrating the copy-to-copy shift and chapter-to-chapter shift designating processing, carried out in S1608 of FIG. 16.

First, in S1801, the CPU 205 determines whether or not only the job-to-job shift has been set. In the case where it is determined that only the job-to-job shift is set, the process advances to S1802, where the CPU 205 obtains the previously-used job-to-job shift position number from the shift setting information holding table (FIG. 13A). Then, in S1803, the CPU 205 determines, as the corresponding shift group, a copy-to-copy and chapter-to-chapter group that does not include the shift position number obtained from the shift group management table (FIG. 13B). Then, in S1804, the CPU 205 determines the job-to-job shift position number included in the corresponding shift number of the corresponding shift group as the shift designation position. Then, in S1805, the CPU 205 saves the determined shift position number as the previously-used job-to-job shift position number in the shift setting information holding table (FIG. 13A). The process then advances to S1605 in FIG. 16, where the CPU 205 changes the shift position setting by saving the determined shift position number as the current shift position number in the shift setting information holding table (FIG. 13A). Then, in S1606, the shift is executed, and in S1607, the paper is shifted and discharged.

Meanwhile, in the case where it is determined in S1801 that a shift aside from the job-to-job shift is set, the process advances to S1806, where it is determined if all of the job-to-job, copy-to-copy, and chapter-to-chapter shift settings are active. In such a case, the process advances to S1807, where the CPU 205 obtains the previously-used job-to-job shift position number from the shift setting information holding table (FIG. 13A). Then, in S1808, the CPU 205 determines, as the corresponding shift group, a copy-to-copy and chapter-to-chapter shift group that includes the shift position number obtained from the shift group management table (FIG. 13B). Then, in S1809, the CPU 205 determines the job-to-job shift position number included in the corresponding shift number of the corresponding shift group as the shift designation position. Then, in S1810, the CPU 205 saves the determined shift position number as the previously-used job-to-job shift position number in the shift setting information holding table (FIG. 13A). The process then advances to S1605 in FIG. 16, where the CPU 205 changes the shift position setting by saving the determined shift position number as the current shift position number in the shift setting information holding table (FIG. 13A). Then, in S1606, the shift is executed, and in S1607, the paper is shifted and discharged.

Meanwhile, in the case where the CPU 205 determines in S1806 that all of the job-to-job, copy-to-copy, and chapter-to-chapter shift settings are not active, the process advances to S1811. In S1811, the CPU 205 obtains the previously-used job-to-job shift position number from the shift setting information holding table (FIG. 13A). Then, in 51812, the CPU 205 obtains the previously-used copy-to-copy and chapter-to-chapter shift position numbers from the shift setting information holding table (FIG. 13A). Then, in S1813, the CPU 205 determines the copy-to-copy and chapter-to-chapter shift group including both of the obtained shift position numbers as the corresponding shift group. Then, in S1814, the CPU 205 sets copy-to-copy and chapter-to-chapter shift position numbers, among the corresponding shift numbers of the determined corresponding shift group, that are not the previously-used copy-to-copy and chapter-to-chapter shift position numbers, as the shift designation positions. Then, in S1815, the CPU 205 saves the determined shift position numbers as the previously-used copy-to-copy and chapter-to-chapter shift position numbers in the shift setting information holding table (FIG. 13A). The process then advances to S1605 in FIG. 16, where the CPU 205 changes the shift position setting by saving the determined shift position number as the current shift position number in the shift setting information holding table (FIG. 13A). Then, in S1606, the shift is executed, and in S1607, the paper is shifted and discharged.

According to the second working example as described thus far, a shift function capable of changing among a plurality (at least four) discharge positions can be executed in the case where a print job in which job-to-job, copy-to-copy, and chapter-to-chapter shifting are designated has been loaded. Accordingly, printed materials can be shifted and the discharge positions thereof changed from print job to print job as well as from copy to copy and chapter to chapter within a job, making it possible to easily identify those printed materials.

Third Working Example

Next, a third working example of the present invention will be described.

The third working example describes an example in which four or more shift positions (five, in the third working example) are divided into the following two groups and control is carried out based thereon. (1) Shift positions used in normal job-to-job and copy-to-copy shifts (shift control using these shift positions will be referred to as "normal shifting"), and (2) shift positions used only for sheets affected by a state change during printing (a paper jam, automatic darkness control, a sheet feed tray switch, or the like) (shift control using these shift positions will be referred to as "special shifting").

Note that the configuration of the printing apparatus 100 and the hardware configuration of the image forming apparatus according to the third working example are the same as those in the first working example, and thus descriptions thereof will be omitted.

FIG. 19A is a diagram illustrating an example of a shift setting information holding table according to the present third working example.

This table is a management table, held in the shift control information storage unit 230, that holds and manages current and past information related to shift settings such as the following:

currently-set shift position number information (current shift position numbers)

previously-used normal shift position numbers previously-used special shift position numbers FIG. 19B is a diagram illustrating an example of the shift group management table according to the third working example.

This table is a table for managing a plurality of shift positions in the shift position management table (FIG. 5B) as a group. This management table is used for managing the grouping of shift positions into a group of shift positions used in normal shifting (a first group) and a group used in special shifting (a second group).

Figure 20:
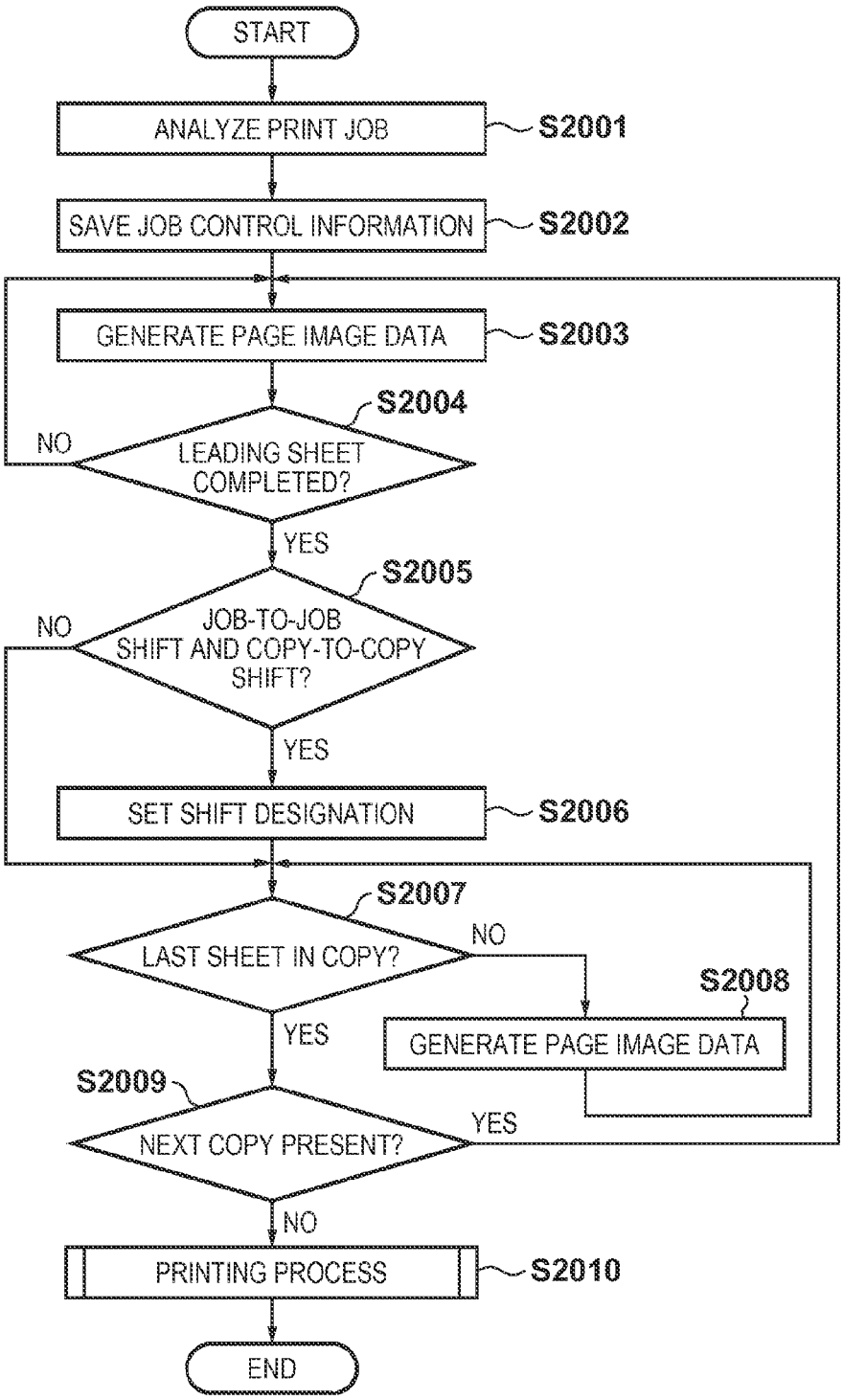
FIG. 20 is a flowchart illustrating a control process carried out by the main controller in the printing apparatus according to a third working example.

FIG. 20 is a flowchart illustrating a control process carried out by the main controller 201 in the printing apparatus 100 according to the third working example. The programs that execute this processing are stored in the ROM 210 and are executed under the control of the CPU 205.

First, in S2001, upon receiving a print job, the CPU 205 analyzes the received job along with the job control unit 225 and obtains control information such as the number of copies (a copy number; N), shift designations (job-to-job, copy-to-copy), a paper feed designation, discharge processing information (stapling, discharge destination), and so on. Then, in S2002, the CPU 205 saves the obtained information in the job control information storage unit 226. Then, in S2003, the RIP 221 generates rasterized image data for each page and saves the data in the RAM 206. Then, in S2004, the CPU 205 determines whether or not rasterized image data has been generated up to and including the leading sheet of the print job, and when up to and including the leading sheet has been rasterized, the process advances to S2005. In S2005, the CPU 205 determines whether or not normal shifting (job-to-job shifting or copy-to-copy shifting) is designated based on the information saved in the job control information storage unit 226. In the case where it is determined that normal shifting is designated, the process advances to S2006, where the CPU 205 sets a normal shifting designation in the discharge control information related to the leading sheet and saves the information in the RAM 206. Then, in S2007, the CPU 205 determines whether or not rasterized image data has been generated for the last sheet of the copy. In the case where the rasterized image data has not been generated up to and including the last sheet of the copy, the process advances to S2008, where the RIP 221 generates the rasterized image data for each page and saves the data in the RAM 206, after which the process returns to S2007. In this manner, when it is determined that the image data has been generated for the last sheet of the copy in S2007, the process advances to S2009, where the CPU 205 determines whether or not there is a next copy. The process returns to S2003 in the case where it is determined that there is a next copy. Meanwhile, in the case where it is determined in S2009 that there is no next copy, the process advances to S2010, where all of the copies designated in the print job are printed based on the rasterized image data and the discharge control information saved in the RAM 206.

Figure 21:
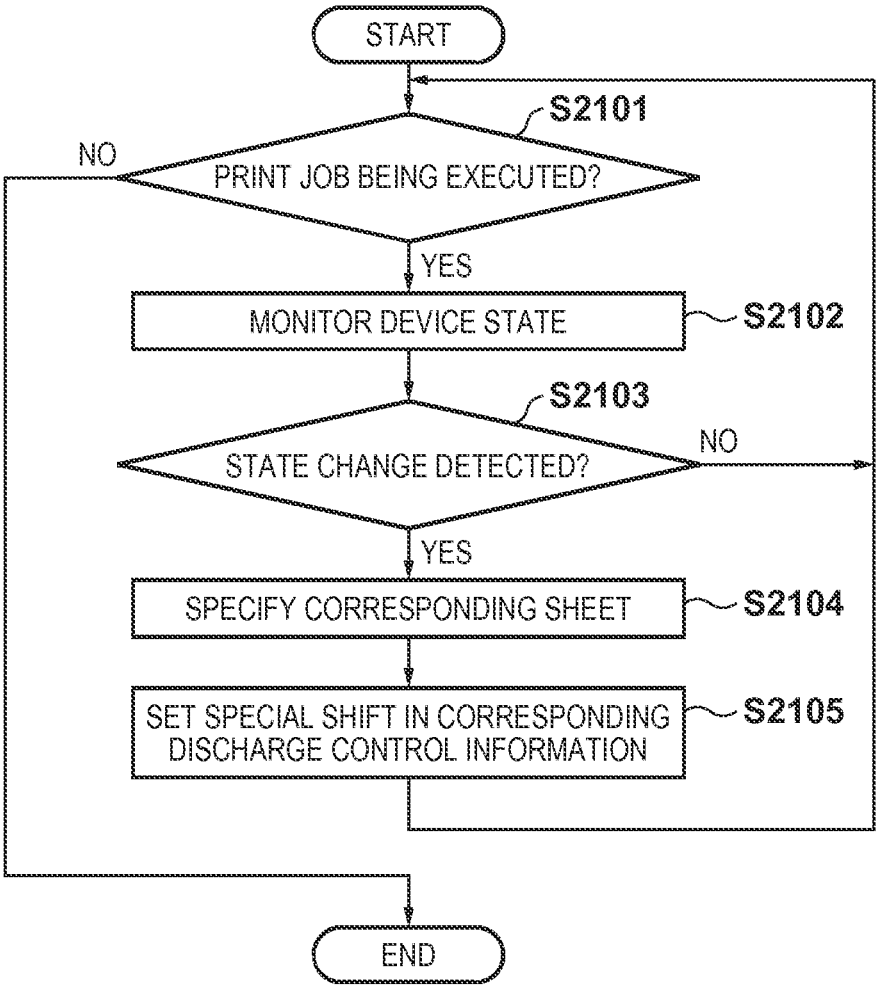
FIG. 21 is a flowchart illustrating a process for setting special shift control according to the third working example.

FIG. 21 is a flowchart illustrating a process for setting special shift control according to the third working example. The programs that execute this processing are stored in the ROM 210 and are executed under the control of the CPU 205.

First, in S2101, the CPU 205 determines whether or not a print job is being executed. In the case where a print job is being executed, the process advances to S2102, where the CPU 205 monitors whether or not a state change (a paper jam, automatic darkness adjustment, a sheet feed tray switch, or the like) has occurred. In the case where the CPU 205 has not detected a state change in S2103, the process returns to S2101, whereas in the case where the CPU 205 has detected a state change in S2103, the process advances to S2104. In S2104, the CPU 205 specifies the first sheet to be printed following the state change. Then in S2105, the CPU 205 sets a normal shifting designation in the discharge control information related to the specified sheet, after which the process returns to S2101. When the execution of the print job ends in S2101, the processing indicated in this flowchart ends.

Figure 22:
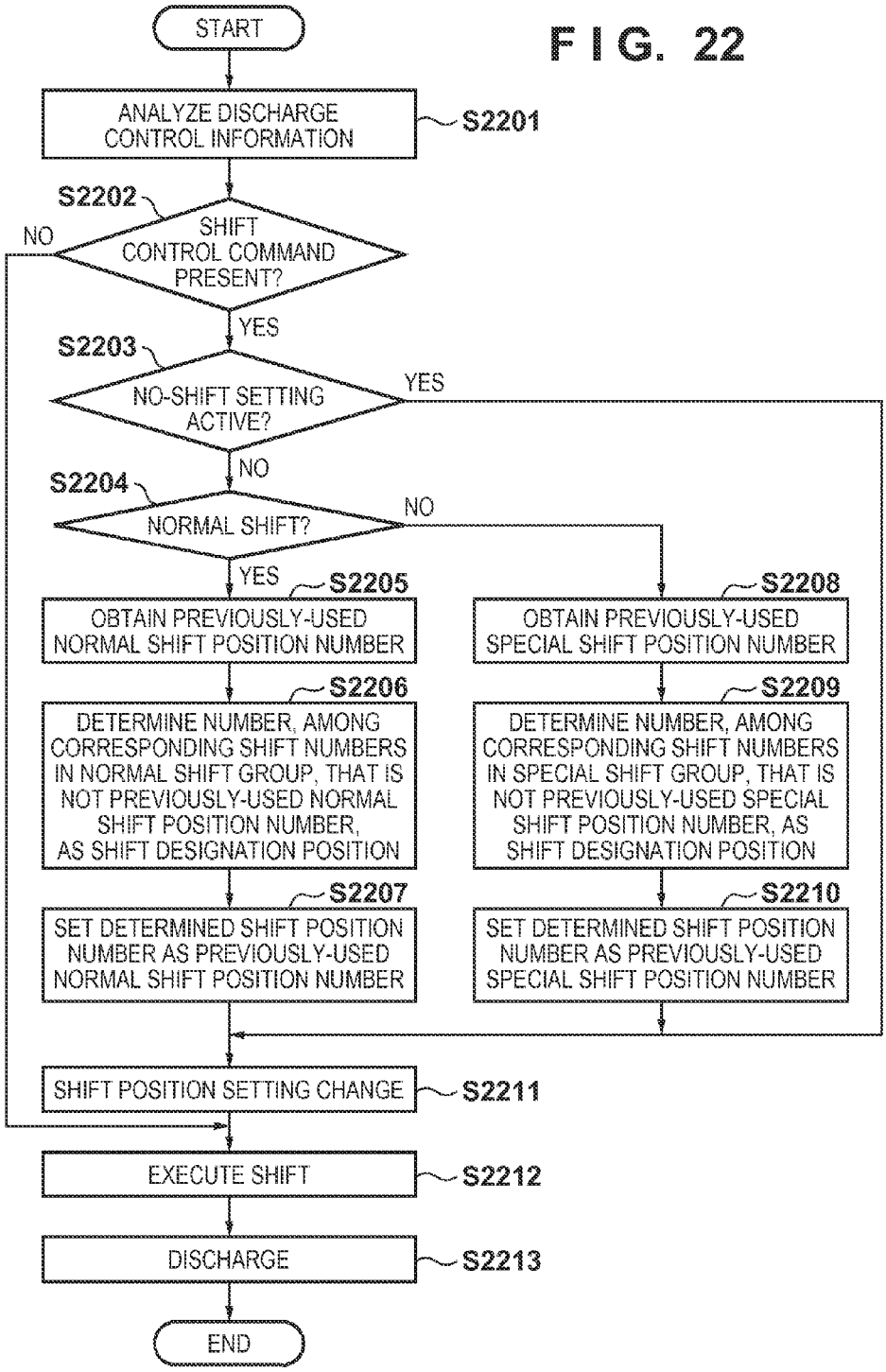
FIG. 22 is a flowchart illustrating a shift control process carried out by the main controller in the printing apparatus according to the third working example.

FIG. 22 is a flowchart illustrating a shift control process carried out by the main controller 201 in the printing apparatus 100 according to the third working example. The programs that execute this processing are stored in the ROM 210 and are executed under the control of the CPU 205.

First, in S2201, the CPU 205 analyzes the discharge control information, added by the discharge control unit 228, that designates discharge processing related to each sheet of paper. Then, in S2202, the CPU 205 determines whether or not a shift control command is set. In the case where it is determined that the shift control command is not set, the process advances to S2212, where the CPU 205 executes the shift using the current shift position settings, without changing the current shift position number in the shift setting information holding table (FIG. 19A). Then, in S2213, the paper is shifted and discharged.

On the other hand, in the case where it is determined in S2202 that the shift control command is set, the process advances to S2203, where the CPU 205 determines whether a no-shift setting is active. In the case where it is determined that the no-shift setting is active, the process advances to S2211, where a shift position number of 0, indicating no shift, is set as the current shift position number in the shift setting information holding table (FIG. 19A), thus changing the shift position setting. Then, in S2212, the shift is executed, and in S2213, the paper is shifted and discharged.

On the other hand, in the case where it is determined in S2203 that the no-shift setting is not active, the process advances to S2204, where the CPU 205 determines whether or not a normal shift setting is active. In the case where it is determined that the normal shift setting is active, the process advances to S2205. In S2205, the CPU 205 obtains a previously-used normal shift position number from the shift setting information holding table (FIG. 19A). Then, in S2206, the CPU 205 determines a number, among the corresponding shift numbers in a normal shift group in the shift group management table (FIG. 19B), that is not the obtained previously-used normal shift position number, as the shift designation. Then, in S2207, the CPU 205 saves the determined shift position number as the previously-used normal shift position number in the shift setting information holding table (FIG. 19A). Then, in S2211, the CPU 205 changes the shift position setting by saving the determined shift position number as the current shift position number in the shift setting information holding table (FIG. 19A). The process then advances to S2212, where the shift is executed, and in S2213, the paper is shifted and discharged.

On the other hand, in the case where it is determined in S2204 that the normal shift is not set (that is, that a special shift is set), the process advances to S2208. In S2208, the CPU 205 obtains a previously-used special shift position number from the shift setting information holding table (FIG. 19A). Then, in S2209, the CPU 205 determines a number, among the corresponding shift numbers in a special shift group in the shift group management table (FIG. 19B), that is not the obtained previously-used special shift position number, as the shift designation. Then, in S2210, the CPU 205 saves the determined shift position number as the previously-used special shift position number in the shift setting information holding table (FIG. 19A). The process then advances to S2211, where the aforementioned processing is executed.

According to the third working example as described thus far, in the case where a print job in which a normal shift (a job-to-job shift, a copy-to-copy shift) is designated has been loaded, a special shift that is executed when a state change has occurred in the device can be used. Accordingly, it is possible to identify where the state change occurred in the printing results while maintaining the distinction between printed materials resulting from normal job-to-job shifts and copy-to-copy shifts.

Fourth Working Example

Next, a fourth working example of the present invention will be described. The fourth working example describes an example in which state changes that trigger special shifting can be selected, in the shift control where special shifting is carried out after a state change in the device as described in the aforementioned third working example. Note that the configuration of the printing apparatus 100 and the hardware configuration of the image forming apparatus according to the fourth working example are the same as those in the first working example, and thus descriptions thereof will be omitted.

Figures 23A, 23B:
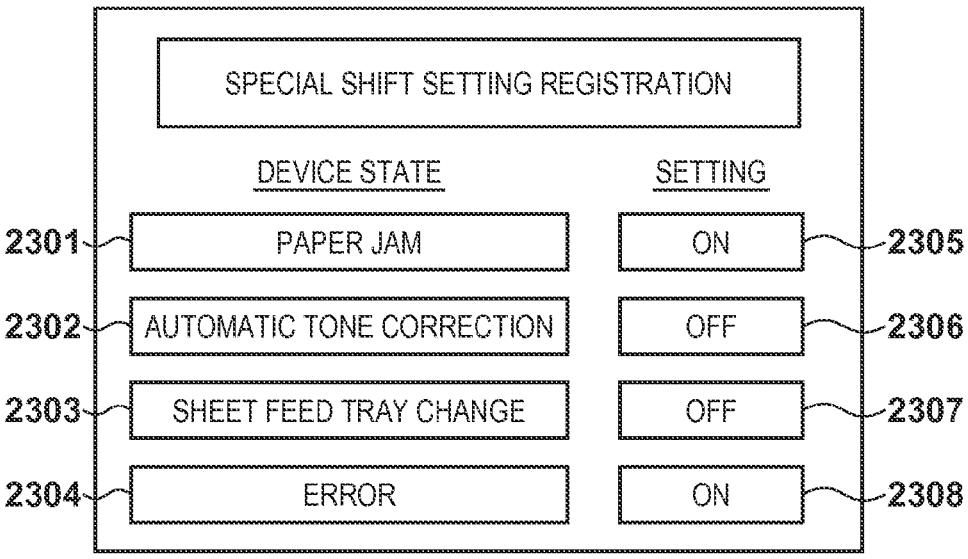
FIGS. 23A and 23B are diagrams illustrating a table and a screen example according to the third working example, where

FIG. 23B is a diagram illustrating an example of a screen for setting device states in which special shifting is to be carried out (special shift setting registration), displayed in the console section 104 of the printing apparatus 100 according to the fourth working example.

In FIG. 23B, 2301 to 2304 each indicate device states that can be detected by the device state monitoring unit 231. Whether to execute special shifting (on) or not to execute special shifting (off) is set for each state. Here, "on" is set for paper jams and errors, as indicated by 2305 and 2308, whereas "off" is set for auto tone correction and sheet feed tray changes, as indicated by 2306 and 2307.

The CPU 205 saves the special shift setting registration in a special shift corresponding state registration table (FIG. 23A) held in the shift control information storage unit 230.

Next, a process for setting special shift control according to the fourth working example will be described.

Figure 24:
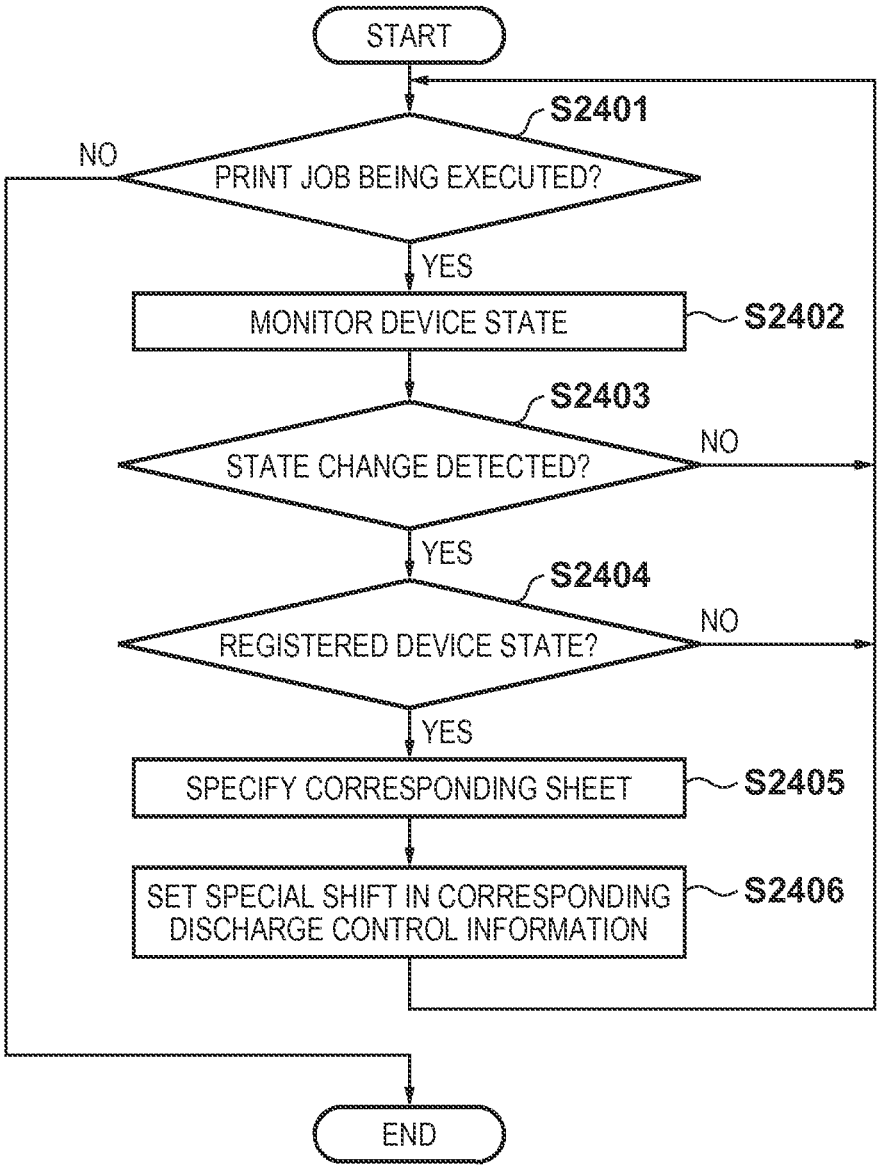
FIG. 24 is a flowchart illustrating a process for setting special shift control in a printing apparatus according to a fourth working example.

FIG. 24 is a flowchart illustrating a process for setting special shift control in the printing apparatus 100 according to the fourth working example. The programs that execute this processing are stored in the ROM 210 and are executed under the control of the CPU 205.

First, in S2401, the CPU 205 determines whether or not a print job is being executed. In the case where it is determined that a print job is being executed, the process advances to S2402, where the device state monitoring unit 231 monitors whether or not a state change (a paper jam, automatic darkness adjustment, a sheet feed tray switch, or the like) has occurred during printing. Then, in S2403, when the CPU 205 detects a state change, the process advances to S2404. In S2404, the CPU 205 determines whether or not a special shift is registered as "on" for the detected state change in the special shift corresponding state registration table (FIG. 23A). In the case where it is determined that the special shift is registered as "off", the process returns to S2401.

In the case where it is determined in S2402 that the special shift is registered as "on", the process advances to S2406, where the CPU 205 specifies the first sheet printed following the state change. Next, in S2406, the CPU 205 sets a special shifting designation in the discharge control information related to the specified sheet, after which the process returns to S2401 and the aforementioned state change detection is continued while the print job is being executed. Other processes are the same as those described in the aforementioned third working example and thus descriptions thereof will be omitted.

According to this fourth working example as described thus far, whether or not to execute special shifting, which is different from the normal shifting and is executed only when a state change has occurred in the device, can be selected based on the state of the device, and thus it is possible to identify only the device state changes that are necessary. Accordingly, it is possible to identify where the state of the device changed in the printing results while maintaining the distinction between printed materials resulting from job-to-job shifts or copy-to-copy shifts within a job. As a result, it is possible, for example, to separate printed materials produced after a state change has occurred in the device, without using separately-prepared partition sheets or the like.

Other Embodiments

Embodiments of the present invention can also be realized by a computer of a system or apparatus that reads out and executes computer executable instructions recorded on a storage medium (e.g., non-transitory computer-readable storage medium) to perform the functions of the above-described embodiment of the present invention, and by a method performed by the computer of the system or apparatus by, for example, reading out and executing the computer executable instructions from the storage medium to perform the functions of the above-described embodiments. The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-117373 filed on Jun. 3, 2013, which is hereby incorporated by reference herein in its entirety.

What is claimed is:

1. A control apparatus comprising:

a discharge unit configured to discharge, into a stacking unit, sheets of a plurality of copies by executing a first job that is set to print a plurality of copies, and configured to discharge, into the stacking unit, sheets of a plurality of copies by executing a second job that is set to print a plurality of copies and follows the first job;

a first determination unit configured to determine whether or not a setting for changing a discharge position between copies in a job is active;

a second determination unit configured to determine whether a setting for changing a discharge position between jobs is active; and a control unit configured to carry out, in the case where the first determination unit determines that the setting for changing the discharge position between copies is active and the second determination unit determines that the setting for changing the discharge position between jobs is active, control so that a sheet discharge position for the plurality of copies discharged by executing the first job changes selectively to a first discharge position in the stacking unit and to a second discharge position in the stacking unit between copies of the first job, and to carry out control so that a sheet discharge position for the plurality of copies discharged by executing the second job changes selectively to a third discharge position in the stacking unit and to a fourth discharge position in the stacking unit between copies of the second job, wherein the control unit carries out, in the case where the first determination unit determines that the setting for changing the discharge position between copies is not active and the second determination unit determines that the setting for changing the discharge position between jobs is active, control so that a sheet discharge position for the plurality of copies discharged by executing the first job is the first position in the stacking unit and a sheet discharge position for the plurality of copies discharged by executing the second job is the fourth position in the stacking unit, and wherein the first discharge position is different from the third discharge position and the fourth discharge position.

2. The control apparatus according to claim 1, wherein the second discharge position is different from the third discharge position and the fourth discharge position.

3. The control apparatus according to claim 1, further comprising:

a printing unit configured to print images onto the sheets of the plurality of copies.

4. The control apparatus according to claim 1, wherein the stacking unit is a stacking tray.

5. A control apparatus comprising:

a discharge unit configured to discharge, into a stacking unit, sheets of a plurality of copies by executing a job;

a first determination unit configured to determine whether or not a setting for changing a discharge position between copies in a job is active;

a second determination unit configured to determine whether or not a setting for changing a discharge position between jobs is active; and a control unit configured to carry out, in the case where the first determination unit determines that the setting for changing the discharge position between copies is active and the second determination unit determines the setting for changing the discharge position between jobs is active, control so that a sheet discharge position for the plurality of copies discharged by executing the job changes selectively to a first discharge position in the stacking unit and to a second discharge position in the stacking unit between copies of the job, and to carry out control so that a sheet discharge position for sheets discharged by executing a different job than the job changes to a third discharge position in the stacking unit that is different from the first discharge position and the second discharge position.

6. A control method comprising the steps of:

discharging, into a stacking unit, sheets of a plurality of copies obtained by executing a first job that is set to print a plurality of copies, and discharging, into the stacking unit, sheets of a plurality of copies by executing a second job that is set to print a plurality of copies and follows the first job;

determining whether or not a setting for changing a discharge position between copies in a job is active;

determining whether or not a setting for changing a discharge position between jobs is active;

carrying out, in the case where it is determined that the setting for changing the discharge position between copies is active and it is determined that the setting for changing the discharge position between jobs is active, control so that a sheet discharge position for the plurality of copies discharged by executing the first job changes selectively to a first discharge position in the stacking unit and to a second discharge position in the stacking unit between copies of the first job, and carrying out control so that a sheet discharge position for the plurality of copies discharged by executing the second job changes selectively to a third discharge position in the stacking unit and to a fourth discharge position in the stacking unit between copies of the second job; and carrying out, in the case where it is determined that the setting for changing the discharge position between copies is not active and it is determined that the setting for changing the discharge position between jobs is active, control so that a sheet discharge position for the plurality of copies discharged by executing the first job is the first position in the stacking unit and a sheet discharge position for the plurality of copies discharged by executing the second job is the fourth position in the stacking unit, and wherein the first discharge position is different from the third discharge position and the fourth discharge position.

7. A non-transitory computer-readable storage medium storing a computer program that causes a computer to execute a control method, the control method comprising:

discharging, into a stacking unit, sheets of a plurality of copies by executing a first job that is set to print a plurality of copies, and to discharge, into the stacking unit, sheets of a plurality of copies by executing a second job that is set to print a plurality of copies and follows the first job;

determining whether or not a setting for changing a discharge position between copies in a job is active;

determining whether or not a setting for changing a discharge position between jobs is active;

carrying out, in the case where it is determined that the setting for changing the discharge position between copies is active and it is determined that the setting for changing the discharge position between jobs is active, control so that a sheet discharge position for the plurality of copies discharged by executing the first job changes selectively to a first discharge position in the stacking unit and to a second discharge position in the stacking unit between copies of the first job, and to carry out control so that a sheet discharge position for the plurality of copies discharged by executing the second job changes selectively to a third discharge position in the stacking unit and to a fourth discharge position in the stacking unit between copies of the second job; and carrying out, in the case where it is determined that the setting for changing the discharge position between copies is not active and it is determined that the setting for changing the discharge position between jobs is active, control so that a sheet discharge position for the plurality of copies discharged by executing the first job is the first position in the stacking unit and a sheet discharge position for the plurality of copies discharged by executing the second job is the fourth position in the stacking unit, and wherein the first discharge position is different from the third discharge position and the fourth discharge position.

* * * * *